US012366371B2

(12) United States Patent
Johnson

(10) Patent No.: US 12,366,371 B2
(45) Date of Patent: Jul. 22, 2025

(54) CHILLER SYSTEM

(71) Applicant: EIDON, LLC, Mercer Island, WA (US)

(72) Inventor: Roger N. Johnson, Mercer Island, WA (US)

(73) Assignee: EIDON, LLC, Mercer Island, WA (US)

( * ) Notice: Subject to any disclaimer, the term of this patent is extended or adjusted under 35 U.S.C. 154(b) by 308 days.

(21) Appl. No.: 17/638,759

(22) PCT Filed: Aug. 27, 2020

(86) PCT No.: PCT/US2020/048100
§ 371 (c)(1),
(2) Date: Feb. 25, 2022

(87) PCT Pub. No.: WO2021/041602
PCT Pub. Date: Mar. 4, 2021

(65) Prior Publication Data

US 2022/0404040 A1 Dec. 22, 2022

Related U.S. Application Data

(60) Provisional application No. 63/039,932, filed on Jun. 16, 2020, provisional application No. 62/894,677, filed on Aug. 30, 2019.

(51) Int. Cl.
*F24F 3/14* (2006.01)

(52) U.S. Cl.
CPC ..... *F24F 3/1417* (2013.01)

(58) Field of Classification Search
CPC .... F24F 3/14; F24F 5/00; B01D 53/26; B01D 53/14; F24B 25/00; F24B 17/00; F24B 15/00
See application file for complete search history.

(56) References Cited

U.S. PATENT DOCUMENTS 4,042,011 A 8/1977 Schneider
4,527,398 A 7/1985 Schaetzle
(Continued)

FOREIGN PATENT DOCUMENTS

CN 101336358 A 12/2008
CN 108474625 A 8/2018
CN 208394816 U 1/2019

OTHER PUBLICATIONS

International Search Report issued on Dec. 16, 2020 in PCT/US20/48100 (4 pages).
(Continued)

*Primary Examiner* — Elizabeth J Martin
(74) *Attorney, Agent, or Firm* — Freestone Intellectual Property Law PLLC; Aaron J. Visbeek

(57) ABSTRACT

A chiller system is provided. The chiller system includes a refrigeration fluid, an evaporative fluid, and an evaporator that contacts the refrigeration fluid and the evaporative fluid to cause a portion of the refrigeration fluid to evaporate. The chiller system also includes, an output heat exchanger that receives at least a portion of an adjacent refrigeration fluid and increase the temperature thereof by transferring the heat of an outside environment of the heat exchanger to the adjacent refrigeration fluid. The heat exchanger directs the portion of the adjacent refrigeration fluid back to the evaporator. The chiller system also includes, a separator that receives the evaporative fluid and the evaporated refrigeration fluid and separates the two by contacting them with a separator component resulting in a separated evaporative fluid and a processed refrigeration component allowing the separated evaporative fluid to return to the evaporator.

15 Claims, 11 Drawing Sheets

(56) References Cited

U.S. PATENT DOCUMENTS

| | | | | |
|---|---|---|---|---|
| 4,984,434 | A | 1/1991 | Peterson et al. | |
| 5,222,375 | A | 6/1993 | Conrad et al. | |
| 9,423,140 | B2 | 8/2016 | Betts et al. | |
| 9,429,332 | B2 | 8/2016 | Vandermeulen et al. | |
| 10,386,084 | B2 | 8/2019 | Bahar et al. | |
| 2014/0260398 | A1 | 9/2014 | Kozubal et al. | |
| 2017/0284685 | A1* | 10/2017 | Bahar | F24F 3/1417 |
| 2017/0284707 | A1* | 10/2017 | Brenner | F25B 15/06 |
| 2018/0128510 | A1 | 5/2018 | LePoudre et al. | |

OTHER PUBLICATIONS

Written Opinion issued Dec. 16, 2020 in PCT/US20/48100 (7 pages).
Extended European Search Report issued in European Patent Application No. 20857392.3 (9 pages).
Chinese Office Action issued Mar. 15, 2024 in Application No. 2020800599647 (2 pages) (English translation only).
International Preliminary Report on Patentability issued in PCT/US20/48100 on Mar. 1, 2022 (8 pages).
International Search Report issued in PCT/US2020/048100 on Dec. 16, 2020 (4 pages).
Written Opinion issued in PCT/US2020/048100 on Dec. 16, 2020 (7 pages).
Chinese Office Action Issued Mar. 4, 2025 in Application No. 2020800599647, 11 pages.

* cited by examiner

CHILLER SYSTEM

CROSS-REFERENCE TO RELATED APPLICATIONS

The present invention is filed under 35 U.S.C. § 371 as the U.S. national phase of International Application No. PCT/US2020/048100, filed on Aug. 27, 2020, which designated the United States and claims the right of priority of U.S. Provisional Application No. 62/894,677, filed on Aug. 30, 2019, and of U.S. Provisional Application No. 63/039,932, filed on Jun. 16, 2020, each of which are hereby fully incorporated herein by reference.

TECHNICAL FIELD

A chiller system, more particularly, a low-pressure sealed chiller system is disclosed herein for use with personal protective equipment.

BACKGROUND

Traditional air conditioning systems operate at high pressures and consequently have high electricity requirements making them inefficient and costly. Traditional systems are open to the environment such that internal fluids must constantly be replaced or have interior degradation of the system. One example includes a constant enthalpy cooling known as a swap cooler. Such a system is generally ineffective in warm humid environments. Accordingly, air conditioners or chillers that address the deficiencies of traditional systems are desired. Also, traditional hazmat suit cooling devices use cold water or ice for internal cooling. This type of cooling is heavy and inefficient. Accordingly, chillers that address these deficiencies of traditional hazmat suits are also desired.

SUMMARY

A chiller system is provided. As described herein, the chiller system may include a refrigeration fluid, an evaporative fluid, and an evaporator that contacts the refrigeration fluid and the evaporative fluid to cause a portion of the refrigeration fluid to evaporate. The chiller system may also include an output heat exchanger that receives at least a portion of an adjacent refrigeration fluid and increase the temperature thereof by transferring the heat of an outside environment of the heat exchanger to the adjacent refrigeration fluid. The heat exchanger directs the portion of the adjacent refrigeration fluid back to the evaporator. The chiller system may also include a separator that receives the evaporative fluid and the evaporated refrigeration fluid and separates the two by contacting them with a separator component resulting in a separated evaporative fluid and a processed refrigeration component allowing the separated evaporative fluid to return to the evaporator. The chiller system may also include a regenerator that receives the processed refrigeration component and isolates the refrigeration fluid therein for return to the evaporator. The sealed fluid chiller system may operate the refrigeration fluid and the evaporative fluid at a pressure less than 2 bars over atmospheric pressure.

A cascading evaporator is provided. As described herein, the cascading evaporator may include an evaporative fluid inlet, a refrigerant fluid reservoir, and a first evaporator stage that is configured to receive an evaporative fluid and contact the evaporative fluid with a refrigerant fluid at a first temperature such that a portion of the refrigerant fluid is evaporated and transported with the evaporative fluid as a ladened fluid. The cascading evaporator may include a second evaporator stage configured to receive the ladened fluid and further configured to contact the ladened fluid with the refrigerant fluid at a second temperature such that a portion of the refrigerant fluid is evaporated and transported with the ladened fluid forming a second ladened fluid.

DETAILED DESCRIPTION

Figure 1:
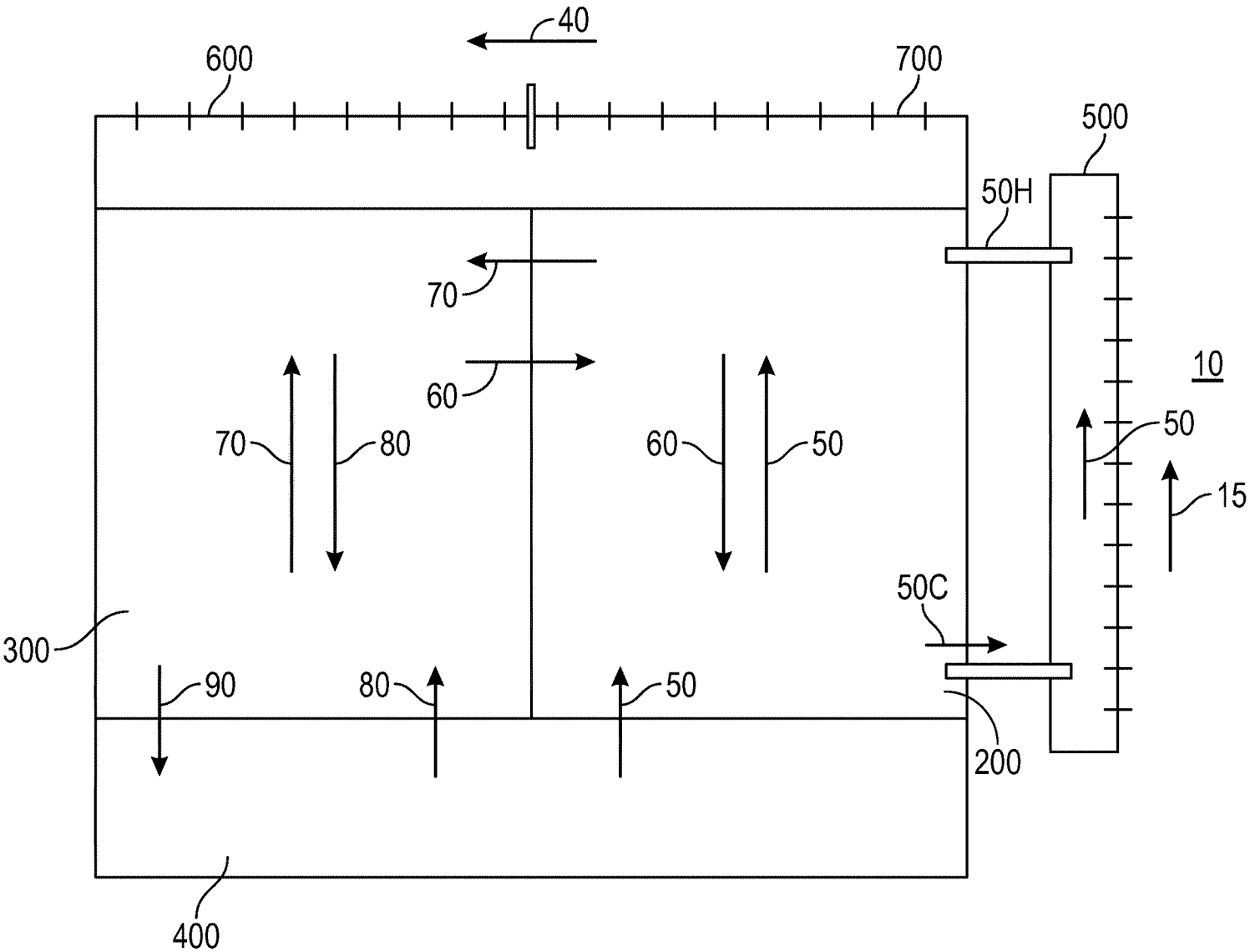
FIG. 1 illustrates a schematic of a sealed chiller system according to embodiments of the present disclosure.

The present invention involves a chiller system that chills a refrigerant fluid that is usable to reduce the temperature of the targeted environment (e.g., the air of a room, the interior of a device, a body within a sealed suit, etc.) via a heat exchanger. For example, embodiments of the invention contemplate keeping the suit dry so the evaporation process allows for the human body to be cooled. In accordance with various embodiments, the chiller system is a low-pressure sealed fluid circuit. The chiller uses evaporation to pull latent heat from the refrigerant. As discussed in more detail below, multiple evaporation mechanisms may be suitable for pulling the latent heat from the refrigerant, some examples include a bubbler and a plate evaporator, but these are not exclusive examples of mechanisms as other suitable evaporators that contact the refrigerant fluid with an evaporator fluid are suitable as well. Heat is pulled directly from the refrigerant fluid that is then sent to the heat exchanger. The evaporation is not specifically directed to the cooling of the evaporative fluid (e.g., air), but instead is directed to creating a chilled refrigerant reservoir/bath suitable to be cycled through the targeted environment heat exchanger. In various aspects of the disclosure herein, the evaporative fluid (e.g., air) serves to limit the amount of heat pulled from the refrigerant fluid (e.g., water) staying below the wet bulb temperature. In other aspects, a body within a sealed suit becomes the evaporator and the chilling effect cools the person's skin and circulation.

In various embodiments discussed herein, the contact between the refrigerant fluid and the evaporative fluid can be staged. The staging of the evaporator can lower refrigerant temperatures below the wet bulb temperatures while approaching the dew point temperatures, allowing the refrigerant to get colder than a single-staged system, which is also disclosed and contemplated herein. The staging of the evaporators allows for the refrigerant to cascade between different temperature baths/reservoirs. The temperature gradient of the refrigerant baths/reservoirs heats the incoming evaporative fluid that effectively cascades in the opposite direction. Warming the evaporative fluid in turn lowers the relative humidity (RH) so that when passed by multiple wetted plates, the evaporation will cool the refrigerant fluid. Under this process, each warmer refrigerant bath/reservoir can add moisture to the passing evaporative fluid stream, which removes additional heat from the refrigerant fluid as it progresses through the stages of the evaporator. The cooled refrigerant is sent to a chilled water circuit. The saturated evaporative fluid can then be sent through a series of stages configured to separate the evaporative fluid from the evaporated refrigerant fluid. In other embodiments contemplated herein, the evaporator and/or the separator can have multiple cascade paths that provide continuous high vapor pressure able to speed both evaporation and separation.

The substantially sealed circuit contains both the working refrigerant fluid, the evaporative fluid, and a separator component (suitable to separate the refrigerant from the evaporative fluid) such that none of the system components/fluids are significantly expended or exposed to the ambient air. The sealed system eliminates fouling from bacterial growth and calcification, which cause fouling of passageways.

Various aspects, embodiments, and examples of a chiller system 100 are discussed below with reference to example illustrations of the same. The various aspects, embodiments, and examples can be incorporated into the system individually or included in any suitable combination with one another.

In accordance with various embodiments, as illustrated in FIG. 1, the chiller system 100 includes a sealed circuit that suitably processes a refrigeration fluid 50 and an evaporative fluid 60 to lower the temperature in a targeted environment (e.g., the air of a room, the interior of a device, a body within a sealed suit, or other suitable environment in which a reduced temperature is desired). The chiller system 100 includes an evaporator 200, a separator 300, and a regenerator 400. The chiller system 100 can also include one or more heat exchangers (e.g., 500, 600, 700, 826). The evaporator 200, the heat exchangers (e.g., 500, 600, 700, 826), the separator 300, and the regenerator 400 maintain the refrigeration fluid 50, the evaporative fluid 60 and/or the separator component 90 in a substantially sealed system that operates near ambient atmospheric pressure in circulating the refrigeration fluid 50 and the evaporative fluid 60. This low or near atmospheric pressure allows for limited energy inputs and simplified construction of the chiller system in order to operate. As used herein, low pressure relates to internal system pressures that are less than 3 bar over the ambient pressure. In accordance with various embodiments, the system operates at less than 2 bar over the ambient pressure. In accordance with various embodiments, the system operates at less than 1½ bar over the ambient pressure. In accordance with various embodiments, the system operates between 1/10 and 1 bar over the ambient pressure.

The evaporator 200 brings the refrigeration fluid 50 and the evaporative fluid 60 into contact with one another. This contact between the fluids allows for a portion of the refrigeration fluid 50 to evaporate and be transported with the evaporative fluid 60. This forms a ladened fluid 70. The ladened fluid 70 can have a saturation of up to 100% relative humidity (RH) and down to anything greater than 0% RH. It is appreciated, however, that the chiller system 100 may experience greater efficiencies when the evaporative fluid is closer to 100% RH. As the refrigeration fluid 50 evaporates, the refrigeration fluid 50 adjacent to the evaporation drops in temperature forming a colder adjacent refrigerant fluid 60C. In some embodiments, this colder refrigerant fluid 60C can be sent to a heat exchanger (e.g., 500) to reduce the temperature of a targeted environment. Additionally or alternatively, the evaporator 200 can include one or more stages for contacting the evaporative fluid 60 and refrigeration fluid 50. Such multi-staged evaporator systems are discussed in more details below but this allows the evaporative fluid 60 to warm up through the stages allowing it to continually transport more and more evaporated refrigerant allowing for greater cooling of adjacent refrigerant.

In accordance with various embodiments, the evaporator 200 receives a substantially unladened evaporative fluid 60, meaning the evaporative fluid 60 is substantially free of evaporated refrigeration fluid 50 or has a low relative humidity. For example, the unladened evaporative fluid 60 may have a relative humidity of less than 10%. Preferably, the unladened relative humidity is less than 5%. To receive the unladened evaporative fluid 60, the evaporator 200 is in fluid communication with the separator 300, which operably separates the refrigerant vapor from the evaporative fluid.

The separator 300 receives the ladened evaporative fluid 70 (e.g., the mixture of the evaporative fluid 60 and the evaporated refrigeration fluid) and separates the two. In one example, this is done by contacting the ladened fluid 70 with a separator component 80 resulting in a separated or unladened evaporative fluid 60 and a processed refrigeration component 90. In various examples, the processed refrigeration component 90 is a mixture of the separator component 80 and the refrigeration fluid 50, allowing the unladened evaporative fluid 60 to return to the evaporator 200. In accordance with various embodiments, the separator 300 can include one or more stages for separating the evaporative fluid 60 and the evaporated refrigeration fluid 70 from one another. While it may be possible to perform this separation in a single-stage, multi-staged separator systems are also contemplated and are discussed in more details below.

In accordance with various embodiments, the separator 300 is a liquid desiccator. In such an embodiment, the separation component 80 is a liquid desiccant. In one example, the liquid desiccant includes glycol. In some embodiments, in which the refrigerant is water or salt water and the evaporative fluid is atmospheric air, the ladened fluid 70 (e.g., water vapor and air) is contacted with the glycol to separate the air from the water vapor. The air can then be returned to the evaporator 200 while the processed refrigerant component 90 (e.g., the mixture of water and glycol) is sent on for further processing by the system.

As discussed above, the system can be substantially sealed, which means the levels of the refrigerant fluid 50, of the evaporator fluid 60, and of the separation component 80 are substantially maintained without significant lost to the environment. Thus, in instances in which the separation component 80 is glycol, the system can be operated for long periods without adding additional glycol to the system. In some embodiments, the evaporative fluid can be an inert gas. For example, oxygen can be replaced in an atmospheric air mixture with the inert gas further prolonging the glycol lifespan. Without contaminates, the piping system for gasses and liquids are kept substantially free flowing in the chiller system 100.

In accordance with some embodiments, peak energy requirements demanded by cooling needs can be buffered by supplying an additional source or reservoir of liquid desiccant. The additional liquid desiccant can be delivered to the fluid circuit from a remote reservoir. In this way, the additional liquid desiccant can be regenerated during times that are off the peak demand times of the overall electricity network running the chiller 100. The regeneration can also occur with energy sources such as waste heat from the system or localized sources such as solar energy.

The desiccant cycle functions as a mirror image of evaporation where the wet bulb limit for evaporation is replaced with the desiccant bulb temperature. In order to maintain a high rate of absorption, the vapor pressure and temperature for the desiccant should be kept low. A thermal cascade provides the means to match the temperature of the vapor to the baths. In this cycle, the coolest desiccant is the richest and is the last to strip water from the air. This keeps the absorption rates high. As with evaporation, dual air streams improve the absorption rate.

The regenerator 400 receives the processed refrigeration component and isolates the refrigeration fluid 50 therein for return to the evaporator 200. In accordance with various embodiments, the regenerator 400 includes a still configured to separate the refrigeration fluid and the desiccant by heating up the mixture and boiling off the refrigeration fluid. The regenerator 400 is in fluid communication with the evaporator 200 and the separator 300. The fluid communication between the regenerator 400 and the separator 300 allows the separated desiccant to be directed back to the separator 300. The fluid communication between the regenerator and the evaporator allows for the separated refrigeration fluid 50 to be directed back to the evaporator.

In accordance with an example, processed refrigerant component 90 is a diluted desiccant (e.g., glycol diluted with water). The diluted desiccant can be regenerated by passing it through a regenerator 400 such as a still. In the still 400, the temperature can reach a sufficient temperature to boil off the refrigerant, for example, 220 F. The high temperature evaporates the refrigerant (e.g., water), which condenses in a return line. In various examples, the desiccant can be thermally stable well above the refrigerant boiling point, e.g., glycol can be stable up to about 300 F. Regenerating the diluted desiccant in a commercial still to purify or separate the water from the desiccant can be accomplished with limited overheating and damage to the desiccant.

In accordance with various embodiments, the chiller system 100 can also include one or more heat exchangers. These heat exchanges can include ones that exchange heat with the external environment and/or ones that exchange heat internally.

In various embodiments, the chiller system 100 includes an output heat exchanger 500 configured to receive at least a portion of the chilled adjacent refrigeration fluid 60C and increase the temperature thereof by transferring the heat of the environment 10 outside of the heat exchanger (e.g., the targeted environment for cooling) to the adjacent refrigeration fluid 60C. The adjacent refrigeration fluid heats up during its path through the heat exchanger 500 as it absorbs the energy from the environment 10. The heated refrigeration fluid 60H is then sent back to the evaporator 200. Thus, in embodiments in which the refrigeration fluid 50 is water, the chilled water is sent to a heat exchanger 500 (e.g., a room radiator heat exchanger) and the environment around the heat exchanger 500 cooled (and dehumidified as needed). The heat exchanger 500 directs the portion of the adjacent refrigeration fluid back to the evaporator 200. This liquid circuit provides easy heat transfer while the short vapor path between the evaporator and separator discussed above minimize pneumatic losses.

In various embodiments, the chiller system 100 includes an internal heat exchanger 700. The internal heat exchanger 700 is operable to exchange heat from different sources internal to the chiller system 100. This source can include exchanging the heat between different fluid flows. For example, in embodiments in which the regenerator 400 is a still, the cross flow liquid heat exchanger 700 (e.g. 710 in FIGS. 4, 5, and 6) can preheat the processed refrigerant component 90 (e.g., the dilute glycol) stream going into the regenerator 400 with the outgoing separated streams (e.g., desiccant and water). This minimizes the temperature difference of the flows, bring the incoming flow up to a higher temperature before it is heated in the regenerator, and lowering the outgoing flow to a lower temperature before it is further cooled. Heat is added to reach the boiling point where the vapor escapes the liquid. After exiting the still, the refrigerant (e.g., water) and pure glycol are cooled with the external heat exchanger 600 and returned to the evaporator 200 and separator 300 at near ambient temperature. This can increase efficiency by limiting losses of the chemical heat of mixing water, desiccant and the energy recycled from the water separation stage.

Additionally or alternatively, the chiller system 100 includes an internal heat exchanger 700 (e.g. 720 in FIGS. 4, 5, and 6), the exchange heat between an outgoing ladened evaporative fluid 70 and the refrigerant 50 return from the regenerator 400. The internal heat exchanger minimized the temperature difference between the ladened evaporative fluid 70 and the refrigerant 50. For example, the ladened evaporative fluid 70 can help to lower the refrigerant 50 temperature before it is used in the evaporator 200. This improves the efficiency of the system, as the system is able to lower the refrigerant 50 temperature easier in the evaporator 200. In general, a spiral cross flow liquid heat exchanger can increase system performance for a limited size cost and thus improve system efficiency.

In various embodiments, the chiller system 100 includes an external heat exchanger 600. The external heat exchanger 600 exchanges the heat inside of the chiller system 100 with ambient air external to the chiller system 100. The ambient air external to the chiller system 100 is air other than the air in the targeted environment 10. For example, if the chiller system 100 cools air in a building, the external heat exchanger 600 would exchange heat with ambient air outside the building. In another example, if the chiller system 100 cools air in a particular room, the external heat exchanger 600 would exchange heat with ambient air outside that room, such as air in another room or outside of the building. In another example, if the chiller system 100 cools air in a protective suit that is wearable for a user, the heat exchanger 600 would exchange heat with the exterior of the suit (e.g. external surface, heat exchanger, or ambient air outside the suit), air in the room, air in another room, or outside of the building. In accordance with various examples, the external heat exchanger 600 receives the refrigeration fluid from the regenerator, exchanges the heat of the refrigeration fluid with the external ambient air, and directs the refrigeration fluid to the evaporator. Additionally or alternatively, the external heat exchanger 600 receives the separator component 90 from the regenerator 400 and directs the separator component 90 to the separator 300 at a near ambient temperature. Additionally or alternatively, the external heat exchanger 600 receives evaporative fluid 60 from the separator and exchanges the heat with the external ambient air, lowering the temperature of the evaporative fluid 60. The heat exchanger 600 then directs the evaporative fluid 60 to the evaporator 200.

In accordance with various embodiments, the refrigeration fluid 50 includes any suitable fluid that readily evaporates in dry air. Preferably, this is accomplished at near ambient pressure. The refrigeration fluid 50 also is one the preferably is able to significantly lower its own temperature by evaporating and removing the heat from the adjacent refrigerant. The refrigeration fluid 50 also is one the preferably is able to readily absorb heat in an output heat exchanger 500 allowing the targeted environment to be cooled. In one example, the refrigeration fluid can include water. Additionally or alternatively, the refrigeration fluid can be a mixture of a fluid along with a salt content such as salt water. The water can be conditioned with salt to lower the freezing point and reduce surface tension. This allows the chilled circuit to provide refrigeration and freezing temperatures. In another example, the refrigeration fluid 50 can include isopropyl alcohol. It is appreciated herein that any suitable fluid can be utilized as a refrigerant.

In accordance with various embodiments, the evaporative fluid 60 includes any suitable fluid that evaporates a portion of the refrigeration fluid 50 and suitably transports the same. In one example, the evaporative fluid 50 includes air (e.g., any combination of gases typical to the environment such as those humans breath). In another example, the evaporative fluid 50 includes an inert gas such as argon. In another example, the evaporative fluid includes gas with low reactivity such as carbon dioxide. It is appreciated herein that any suitable fluid can be utilized as an evaporative fluid 50.

Figure 2:
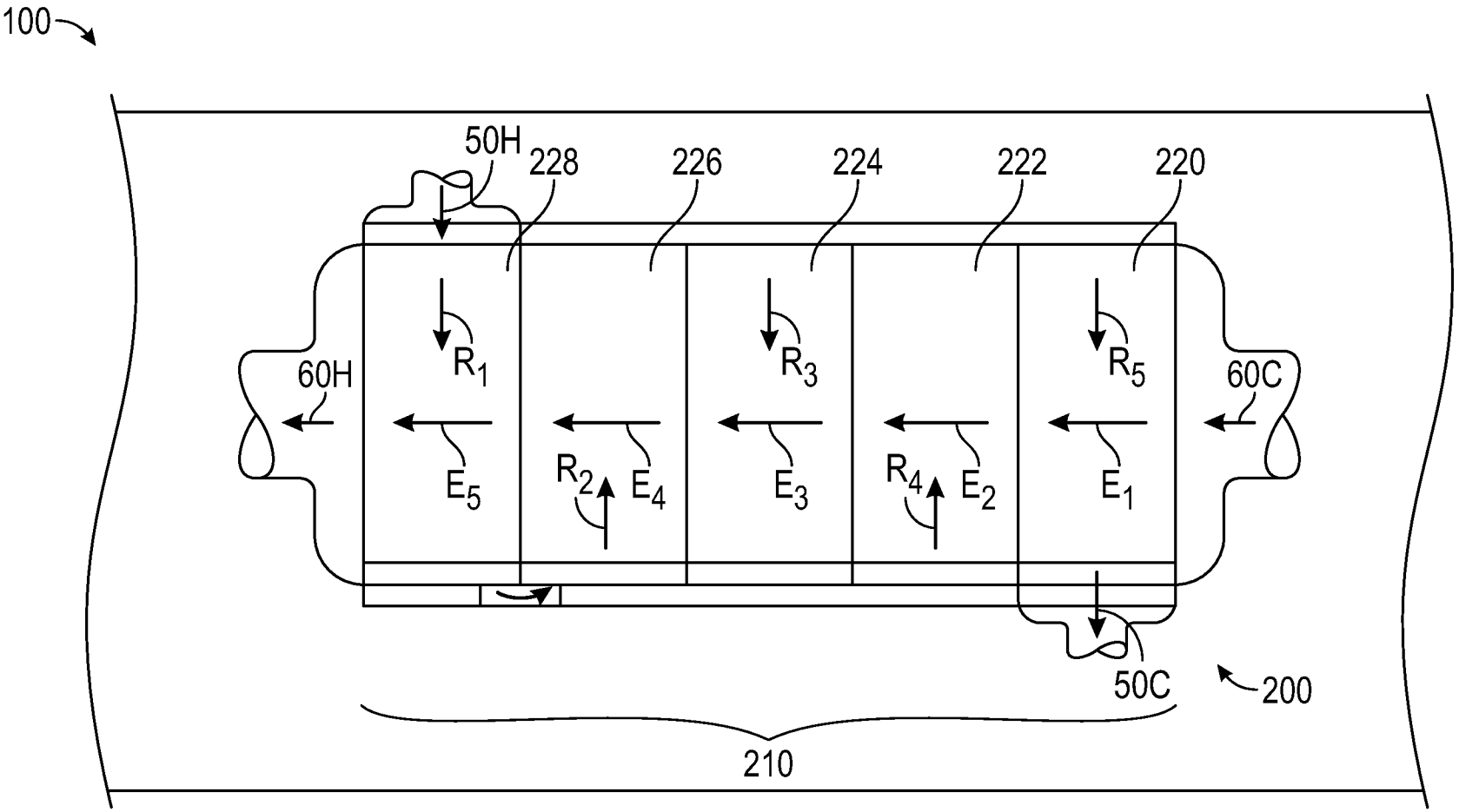
FIG. 2 illustrates a schematic of a cascade evaporator usable with the chiller system of FIG. 1 according to embodiments of the present disclosure.

In accordance with various embodiments, as illustrated in FIG. 2, the evaporator 200 discussed above with respect to FIG. 1 can include a cascade of evaporative stages 210. As shown in FIG. 2, the evaporator 200 can be a part of the chiller system 100. However, it is appreciated that a cascade evaporator 210, as shown, can be included as an evaporator in other types of systems, such as humidifiers.

The cascade evaporator 200 includes a plurality of evaporative stages (e.g. 220, 222, 224, 226, 228). Each of these different stages conforms to different temperature sections. These different temperature sections can preheat the evaporative fluid 60 (e.g., airstream) to higher relative temperatures at each stage. This limits the evaporative fluid 60 (e.g., airstream) from nearing total saturation (e.g. 100% relative humidity). The different evaporative stages (e.g. 220, 222, 224, 226, 228) can also include different refrigerant baths/reservoirs. The different refrigerant baths/reservoirs also relate to different temperatures of the refrigerant. In the different stages, the evaporative fluid 60 and the refrigerant fluid 50 contact one another (e.g., plate evaporator embodiment described below). The contact at each of the different stages allows the fluids to contact one another across a range of temperatures. As the temperatures increase, the evaporative fluid can absorb more of the vapor from the refrigerant. Each stage adiabatically cools the refrigerant fluid 50 (e.g., water) with evaporative fluid 60 (e.g., airstream) that begins with vapor at a first relative humidity (RH) (e.g., ~10% RH) and evaporates the refrigerant fluid 50 (e.g., water) from the evaporator mechanism (e.g., wetted plate water film) at a higher relative humidity (e.g., ~40% RH). This vapor is then introduced into a warm enough stage, dropping the vapor back to a lower relative humidity (e.g., ~10% RH) where the evaporation and resulting heat extraction from the refrigerant fluid 50 (e.g., water) can continue. The evaporator 200 cycles the refrigerant fluid 50 (e.g., water) at a rate that limits the complete evaporation of the refrigerant fluid 50 allowing for significant cooling of the adjacent refrigerant and then collecting the chilled refrigerant fluid 50 into reservoirs in each stage. Since heat/energy is extracted from the ambient environment during evaporation, liquid in contact with the vapor is able to reduce the liquid temperature since heat conduction across the single molecule surface tension skin is higher than what can be pulled from the gas. For example, in a plate evaporator 240, the system maintains a thin surface film on the plates that continually drains into the bath the plates set in.

As shown in FIG. 2, the lowest humidity evaporative fluid 60*c* enters on the same stage as the coolest refrigerant fluid 50*c* exits. In stage 220, the evaporative fluid E1 has a first humidity and a first temperature and contacts the refrigerant R5 having a first temperature. A portion of the refrigerant evaporates and mixes with the evaporative fluid. The refrigerant vapor is then transported to stage 222 with the evaporative fluid. In stage 222, the evaporative fluid E2 has a second humidity and a second temperature and contacts the refrigerant R4 having a second temperature. Here, a portion of the refrigerant evaporates and mixes with the evaporative fluid. The refrigerant vapor is then transported to stage 224 with the evaporative fluid. In stage 224, the evaporative fluid E3 has a third humidity and a third temperature and contacts the refrigerant R3 having a third temperature. Here, a portion of the refrigerant evaporates and mixes with the evaporative fluid. The refrigerant vapor is then transported to stage 226 with the evaporative fluid. In stage 226, the evaporative fluid E4 has a fourth humidity and a fourth temperature and contacts the refrigerant R2 having a fourth temperature. Here, a portion of the refrigerant evaporates and mixes with the evaporative fluid. The refrigerant vapor is then transported to stage 228 with the evaporative fluid.

Figure 6:
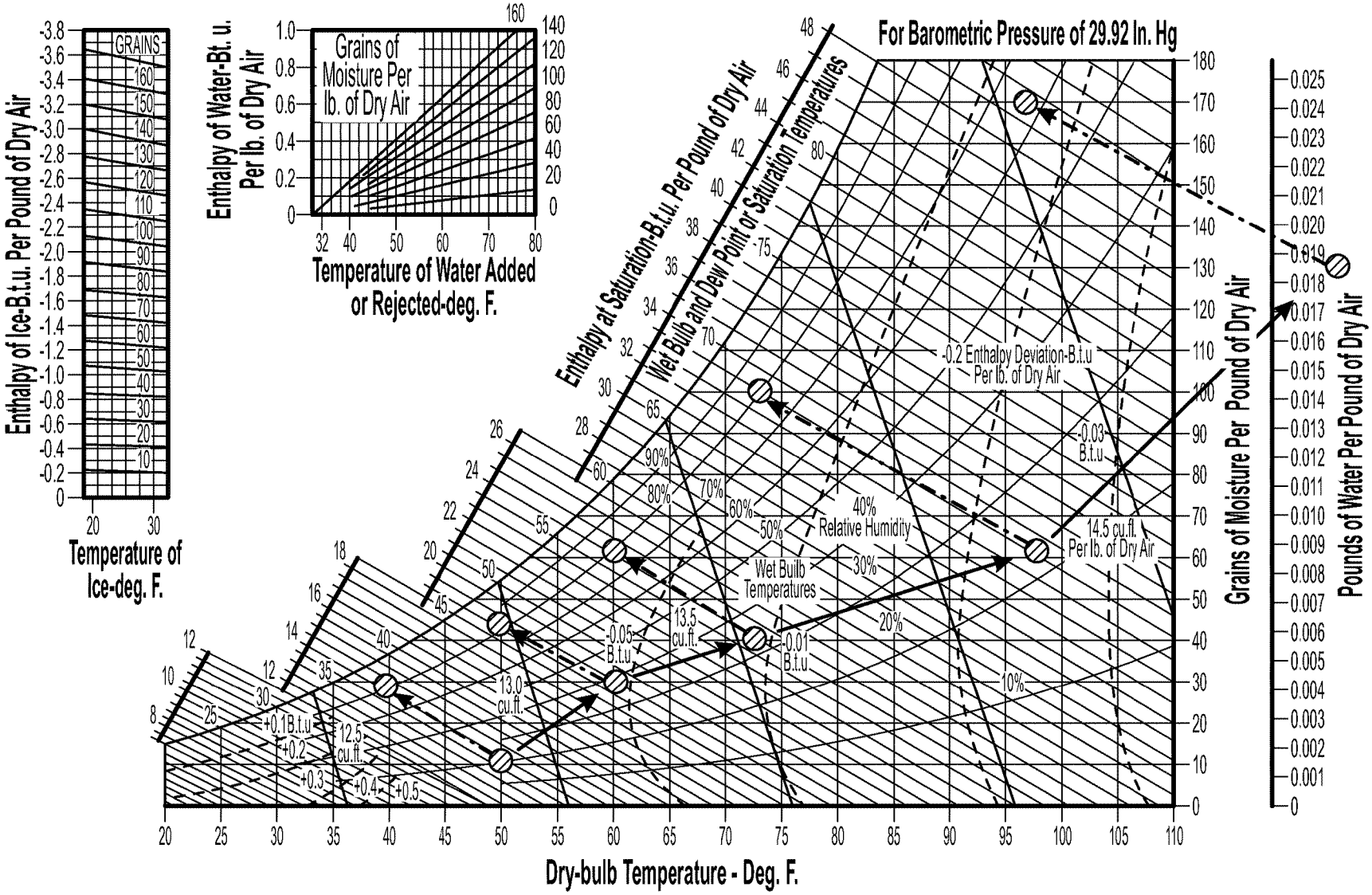
FIG. 6 illustrates a physiometric chart related to the chiller system of FIG. 3 according to embodiments of the present disclosure.

In stage 228, the evaporative fluid E5 has a fifth humidity and a fifth temperature and contacts the refrigerant R1 having a fifth temperature. Here, more of the refrigerant evaporates and mixes with the evaporative fluid. The refrigerant vapor is then transported out of the evaporated with the evaporative fluid 60H. The refrigerant decreases in temperature from R1-R5. The evaporative fluid increases in temperature from E1-E5. This allows the RH of the evaporative fluid to drop with each successive temperature increase allowing it to absorb more vapor. In this way, the evaporative fluid continues to be effective in evaporating refrigerant throughout a broader range of contact with the refrigerant. The chart in FIG. 6 provides detailed characteristics of this activity and is discussed in more detail below.

Figure 3:
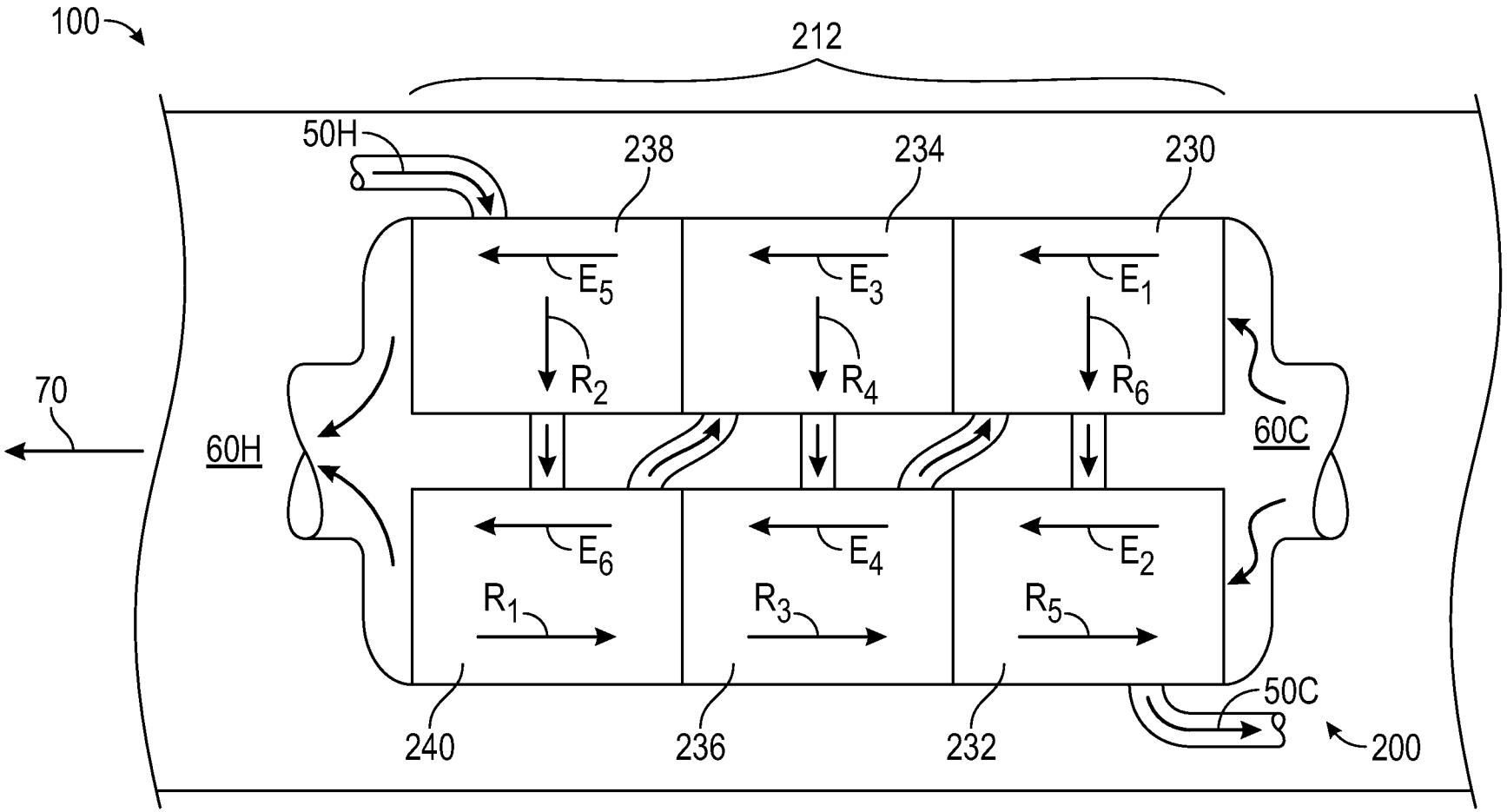
FIG. 3 illustrates a schematic of a multi-channel cascade evaporator usable with the chiller system of FIG. 1 according to embodiments of the present disclosure.

In accordance with various embodiments, as illustrated in FIG. 3, an evaporator can include multiple channels connecting the evaporative stages cascade evaporator. Similar to FIG. 2, the lowest humidity evaporative fluid 60*c* enters on the same stages as the cooler refrigerant fluids. In this embodiment, the evaporative fluid 60*c* follows two different channels. In stage 230, the evaporative fluid E1 is the first evaporative stage along a first channel and has a first humidity and a first temperature and contacts the refrigerant R6 having a first temperature. A portion of the refrigerant evaporates and mixes with the evaporative fluid. The refrigerant vapor is then transported to stage 234 with the evaporative fluid. In stage 234, the evaporative fluid E3 has a second humidity and a second temperature and contacts the refrigerant R4 having a second temperature. Here, a portion of the refrigerant evaporates and mixes with the evaporative fluid. The refrigerant vapor is then transported to stage 238 with the evaporative fluid. In stage 238, the evaporative fluid E5 has a third humidity and a third temperature and contacts the refrigerant R2 having a third temperature. Here, a portion of the refrigerant evaporates and mixes with the evaporative fluid. The refrigerant vapor is then transported out of the evaporated with the evaporative fluid 60H.

Warming the evaporative fluid in turn lowers the relative humidity (RH) so that when passed by multiple stages (e.g. wetted plates or bubblers or the like) evaporation will cool the refrigerant (e.g. water film). In this fashion, each warmer bath can add vapor to the passing evaporative fluid (e.g., air stream), which removes additional heat from the refrigerant (e.g. falling water film.) The cooled refrigerant (e.g., water) from the bottom bath is sent to a chilled water circuit. Simultaneously the saturated evaporative fluid (e.g., air) is regenerated by being sent through a series of baths to separate the refrigerant vapor (e.g., via liquid desiccant wetted plates of increasing concentration until it is dried) from the evaporative fluid and returned to the evaporator. This design (and variations with multiple cascade paths see below) provide continuous high vapor pressure able to speed both evaporation and separation (e.g., desiccation).

A separate channel starts in stage 232. In stage 232, the evaporative fluid E2 is the first evaporative stage along a first channel and has a first humidity and a first temperature and contacts the refrigerant R6 having a first temperature (e.g. the coldest temperature). A portion of the refrigerant evaporates and mixes with the evaporative fluid. The refrigerant vapor is then transported to stage 236 with the evaporative fluid. In stage 236, the evaporative fluid E4 has a second humidity and a second temperature and contacts the refrigerant R3 having a second temperature. Here, a portion of the refrigerant evaporates and mixes with the evaporative fluid. The refrigerant vapor is then transported to stage 240 with the evaporative fluid. In stage 240, the evaporative fluid E6 has a third humidity and a third temperature and contacts the refrigerant R1 having a third temperature. Here, a portion of the refrigerant evaporates and mixes with the evaporative fluid. The refrigerant vapor is then transported out of the evaporated with the evaporative fluid 60H.

Figure 7:
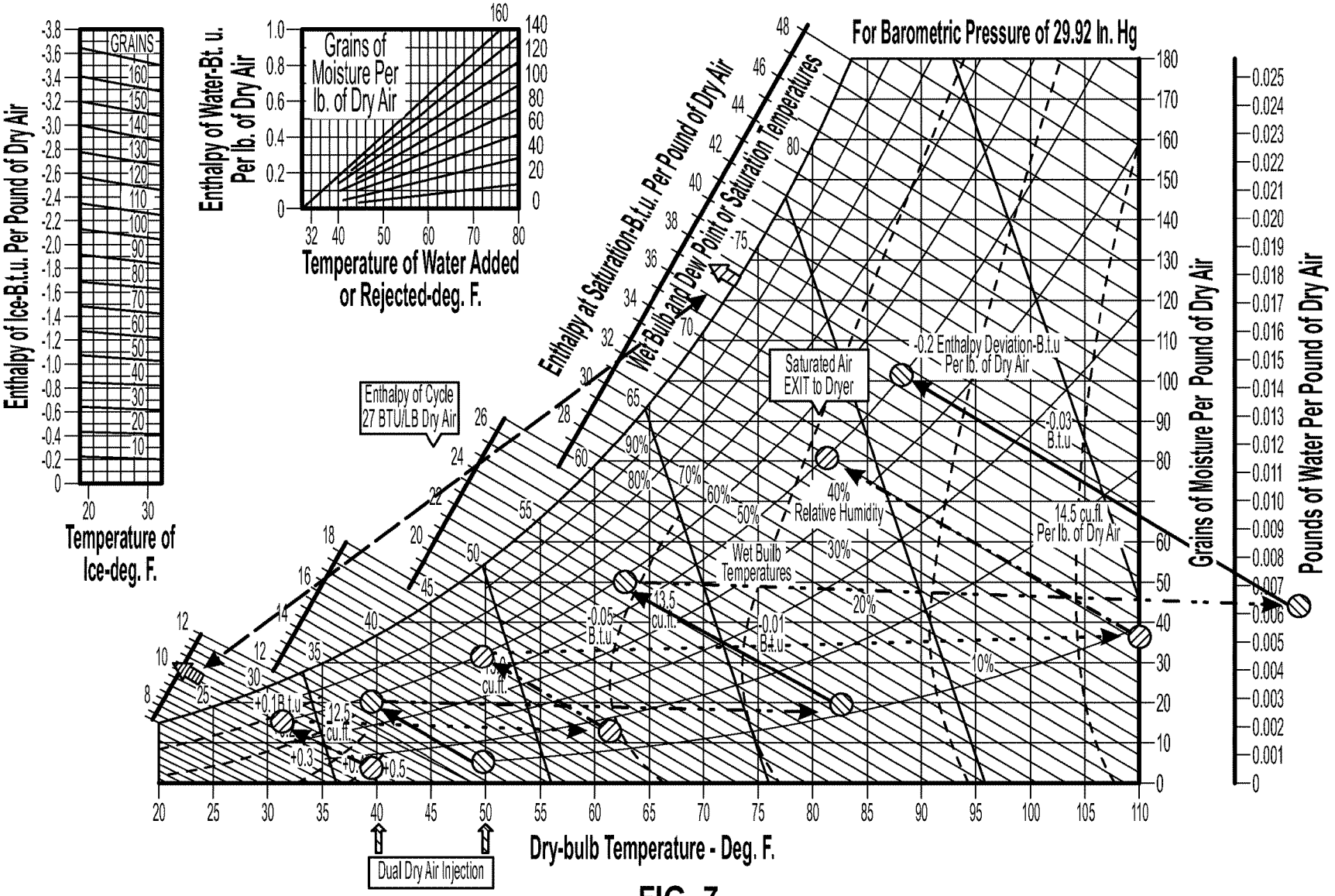
FIG. 7 illustrates a physiometric chart related to the chiller system of FIG. 4 according to embodiments of the present disclosure.

In this system and process, the refrigerant decreases in temperature from R1-R6 in successive cascades as the refrigerant follows the entire range of stages 240 then 238 then 236 then 234 then 232 then 230. The evaporative fluid increases in temperature from E1 to E3 to E5 along one path and E2 to E4 to E6 along another path. This allows the RH of the evaporative fluid to drop a greater amount due to larger successive temperature increases allowing it to absorb more vapor. In this way, the evaporative fluid continues to be effective in evaporating refrigerant throughout each channel across a broader range of contact with the refrigerant. The chart in FIG. 7 provides detailed characteristics of this activity and is discussed in more detail below.

The dual channel cascade evaporator 212 of FIG. 3 and the single channel cascade evaporator 210 of FIG. 2 can be used individually or in combination in the various chillers (or other systems) discussed herein. While only shown with one system in FIGS. 4 and 5, the systems of FIGS. 4 and 5 could likewise be used with the other system not shown.

In accordance with various embodiments, the liquid desiccator can also include a cascading liquid desiccator having a plurality of cascading drying stages in which the ladened evaporative fluid 70 is contacted with multiple stages of liquid desiccant to sequentially dry or separate the evaporative fluid from the refrigerant. Such a liquid desiccator is similar to the evaporator shown above. Examples of this cascading desiccator are shown in FIGS. 4 and 5.

Figure 4:
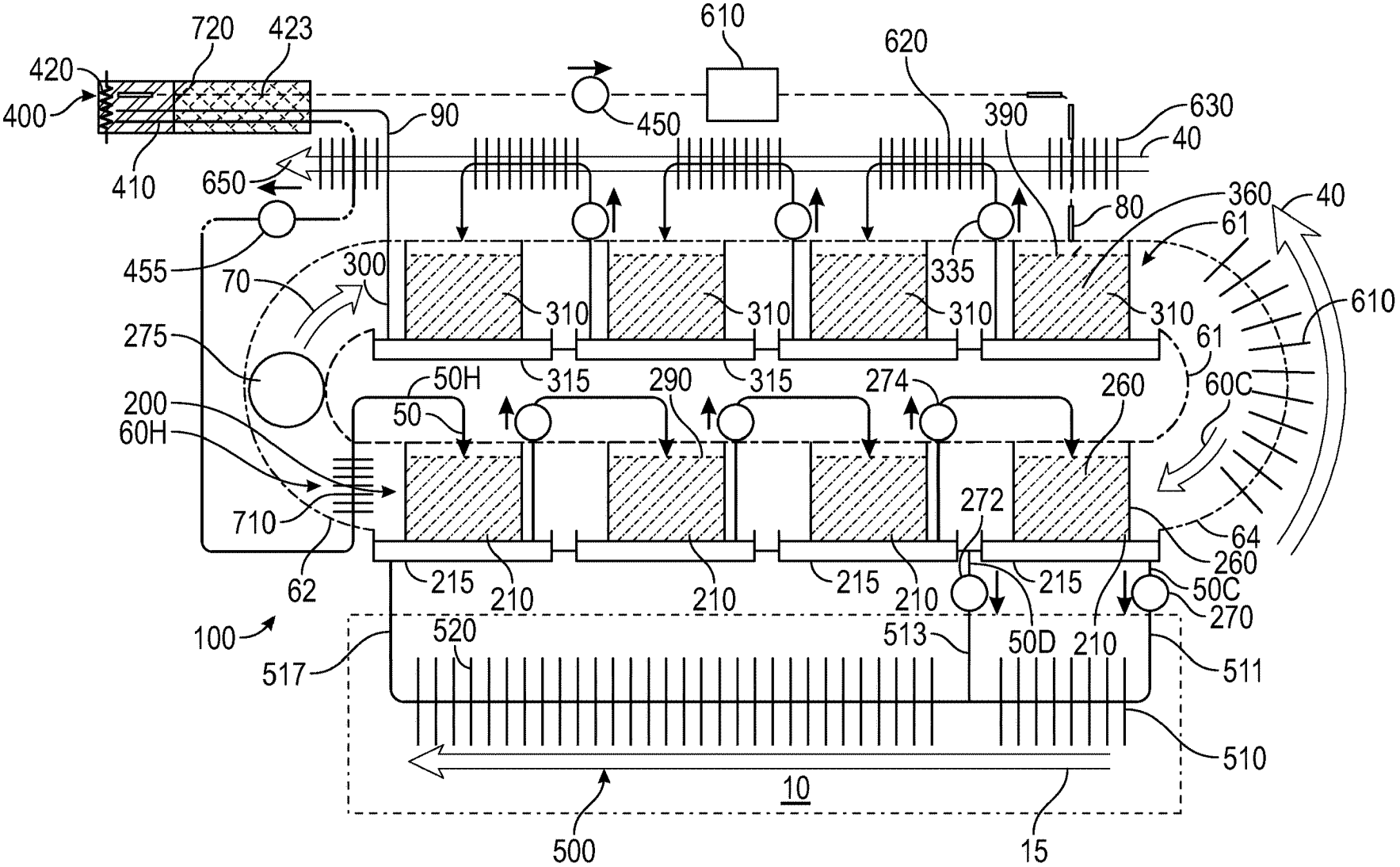
FIG. 4 illustrates a schematic of a cascading evaporative plate chiller system according to embodiments of the present disclosure.
Figure 5:
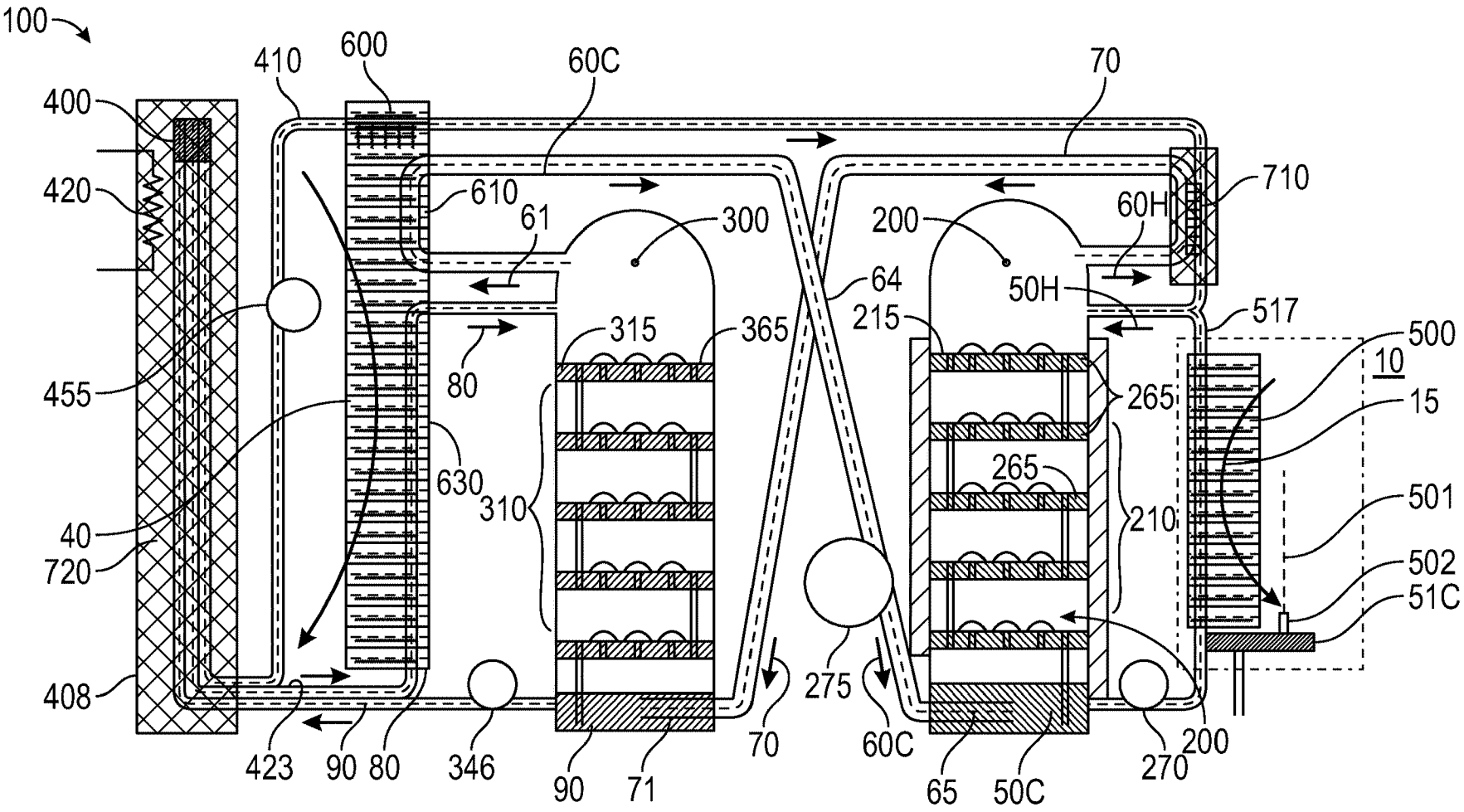
FIG. 5 illustrates a schematic of a cascading evaporative bubbler chiller system according to embodiments of the present disclosure.

In accordance with various embodiments, as illustrated in FIG. 4, the chiller system 100 can include an evaporator 200 having cascading evaporative stages 210. Each of the stages include a stack of plates 260. As shown in FIG. 4, a low temperature dry airflow 60C enters into evaporator 200 via a conduit 64. The airflow 60 passes through the cascading evaporative stages 210 contacting one or more of evaporative plate stacks 260. In accordance with one embodiment, each of the plate stacks 260 may include plates wetted via water 50 forming a film surface there over. The plates may be spaced to accommodate airflow. The spacing may be from 50 mils to 500 mils. In one example, the plates are about 75 mils apart. This spacing is configured to impose minimal drag to the passing airflow while bringing the dry air close to the film surface. In one example, the flow accommodates about 140 cfm airflow that can be suitable to attain the 1.5 T of refrigeration. However, higher and lower flows of air are contemplated as well. For example, the airflow may be from 25 cfm to 500 cfm. Each of the plate stacks may include a bath 215. Each subsequent plate stack may be in communication with the previous bath such that the water can cascade from one stage to the next starting with water flow 50H and progressing to the other end of the cascade and exiting as water flow 50C decreasing in temperature. The plate assembly in the baths are wetted with a supply of liquid from the top of each of the plates or plate stacks. A thin film can follow the surface down to the bath at a rate determined by the circulation pump. The plate surface may be wetted with the fluid so it adheres while flowing slowly down the surface. In various examples, plastic fabrics and/or screens may be used to form the plates. In other examples, conductive plates may be used.

In various embodiments, inter stack pumps 274 may be used to motivate the water from one stage and bath to the next. Drip screens 290 may span the plate stacks to disperse water thereon.

The air flow may progress in the opposite direction flowing from one stage to the next starting with airflow 60C and progressing to the other end as airflow 60H, increasing in temperature. As discussed herein, the air picks up the water vapor forming a ladened air 70. The air can be motivated through the system via a blower 275. This may operate at as little as about 1/10 of a bar in the system.

The chiller system 100 as shown in FIG. 4 may also include a separator 300. The separator 300 may mirror the evaporator as shown, or alternatively it may be comprised of a different style of separator such as another one disclosed herein or otherwise known. Here the separator 300 is shown as a cascading stacked plate 310 separator that receives the ladened air 70 via conduit 62. Each of the stages include a stack of plates 360. As shown in FIG. 4, a low ladened air enters into separator 300 via a conduit 62. The airflow 70 passes through the cascading separator stages 310 contacting one or more of separator plate stacks 360 or more specifically glycol 80 distributed over the plate stacks 360. The plate stacks 360 may include plates wetted via glycol 80, forming a film surface there over. Drip screens 390 may span the plate stack 310 to disperse water thereon. The plates may be spaced to accommodate airflow. The spacing may be from 50 mils to 500 mils. In one example, the plates are about 75 mils apart. Like the evaporator, spacing is configured to impose minimal drag to the passing airflow while bringing the ladened air 70 close to the film surface. In one example, the flow is the same as that of the evaporator.

Each of the plate stacks 310 may include a bath 315. Each subsequent plate stacks may be in communication with the previous bath such that the glycol can cascade from one stage to the next starting with glycol flow coming from the regenerator 400 on the end of the stages where dry air 61 exits into conduit 64. The glycol progresses to the other end of the cascade and exiting as processed refrigerant component 90 (e.g., a mix of water and glycol). The plate assembly in the baths are wetted with a supply of glycol from the top of each of the plates or plate stacks. A thin film can follow the surface down to the bath at a rate determined by the circulation pump 335. The circulation pump may direct the glycol through interbath heat exchangers 620. The interbath heat exchangers 620 transfer the heat between the ambient air 40 (not the target environment air) and the glycol, biasing the glycol temperature close to ambient temperature.

The airflow may progress in the opposite direction relative to the glycol flowing from one stage to the next starting with airflow 70 and progressing to the other end as airflow 61. The dry air 61 can be directed to the evaporator 200 via conduit 64. The conduit 64 may pass the dry air 61 though an ambient air heat exchanger 610 (not target environment air) biasing the airflow 61 to an ambient temperature before reintroducing the air as cool dry air 60C into the evaporator 200.

The processed refrigerant component 90 is directed to the regenerator 400. As shown, the regenerator 400 is a still having a heater 420. The heater 420 heats the processed refrigerant component 90 to a boiling point where the water boils off, thereby separating the water and the glycol. The water is directed along a condensation line 410 back to the evaporator entering as water 50H. The glycol is directed along desiccant line 423 back to the separator 300. The regenerator includes a cross flow heat exchanger 720 that exchanges heat between the water condensate, the glycol, and the processed refrigerant component 90 biasing the three to a similar temperature. After exiting the regenerator 400, the condensate line may pass through an ambient air exchanger 650 lowering the condensate temperature. The condensate may be motivated via a still water pump 455 and directed to a second heat exchanger that biases the water temperature and the ladened air 60H temperature to be similar. The water is then directed back to the evaporator as water 50H and introduced into the first evaporator stack.

The glycol is directed from the still as a strong desiccant having been regenerated and motivated via a strong desiccant pump 750. The glycol may pass through and ambient heat exchanger 630 lowering the glycol temperature closer to ambient air temperature (not target air temperature) and returned to the separator 300 circuit. Additionally or alternatively, the glycol may be returned to a glycol reservoir 610 for storage.

The evaporator may directed chilled water 50C or 50D to a target environment 10 via heat exchanger 500. The chilled water 50C is the coldest water and may be directed via conduit 511. This flow may be pumped through the exchanger 500 via a pump 270. This water is the coldest in the circuit at this point and as such, the heat exchanger 510 is usable for extracting the most heat from the air 15 in target environment 10. The water 50D is an intermediate temperature and can be directed to heat exchanger 520 via conduit 513. This water source can be used to minimize condensation from the air 15 in environment 10 as it is not as cold but may none-the-less be sufficient to lower the temperature of air 15 an appropriate amount. The water from heat exchanger 500 is directed back to the evaporator 200 via conduit 517.

While FIG. 4 is described with regards to specific examples of components (e.g., water as refrigerant, air as evaporative fluid, stacked plates and evaporative mechanism, etc.), it should be appreciated that other embodiments or examples of the various components as described herein may be substituted herein without departing from the scope of this disclosure.

In accordance with various embodiments, as illustrated in FIG. 5, a chiller system can include a cascading evaporative bubble chiller system.

In accordance with various embodiments, as illustrated in FIG. 5, the chiller system 100 can include an evaporator 200 having cascading evaporative stages 210. Each of the stages include a bubbler 265. As shown in FIG. 5, a low temperature dry airflow 60C enters into evaporator 200 via a conduit 65. The airflow 60C passes through the cascading evaporative stages 210 contacting one or more of evaporative bubbler baths 265. In accordance with one embodiment, each of the evaporative bubbler baths 265 may include baths in which the air 60 is bubbled through water 50 causing some of water 50 to evaporate. The depth of the baths 215 may be selected to accommodate airflow and maximize evaporation to reduce the bath temperature. Each of the baths may be connected so that the water 50 can cascade down the column as the temperature is reduced. The water may cascade from one stage to the next starting with water flow 50H and progressing to the other end of the cascade and exiting as water flow 50C decreasing in temperature.

In various embodiments, pump 270 may be used to motivate the water from the final bath to the heat exchanger 500. The heat exchanger 500 can include one or more of a humidity screen 501 or an evaporative valve 502 suitable to monitor and control the output to the target environment 10

The air flow may progress in the opposite direction flowing from one stage to the next starting with airflow 60C and progressing to the other end as airflow 60H increasing in temperature. As discussed herein, the air picks up the water vapor forming a ladened air 70 by bubbling through the baths at each stage. The air can be motivated through the system via a blower 275. This may operate at as little as about 1/10 of a bar in the system.

The chiller system 100 as shown in FIG. 5 may also include a separator 300. The separator 300 may mirror the evaporator as shown or alternatively it may be comprised of a different style of separator such as another one disclosed herein or otherwise known. Here the separator 300 is shown as a cascading bubbler separator 310 that receives the ladened air 70 via conduit 71. Each of the stages include a bath 365. As shown in FIG. 5, ladened air enters into separator 300 via a conduit 71. The airflow 70 passes through the cascading separator stages 310 contacting one or more of separator baths 365 or more specifically glycol 80 within the bath 365. In one example, the flow is the same as that of the evaporator.

Each of the stages 310 may include a bath 315. Each subsequent bath may be in communication with the previous bath such that the glycol can cascade from one stage to the next, starting with glycol flow coming from the regenerator 400. The glycol progresses to the other end of the cascade and exits as processed refrigerant component 90 (e.g., a mix of water and glycol).

The airflow may progress in the opposite direction relative to the glycol flowing from one stage to the next starting with airflow 70 and progressing to the other end as airflow 61. The dry air 61 can be directed to the evaporator 200 via conduit 64 and injected at conduit 65. The conduit 64 may pass the dry air 61 though an ambient air heat exchanger 610 (not target environment air) biasing the airflow 61 to an ambient temperature before reintroducing the air as cool dry air 60C into the evaporator 200. Exchanger 610 may be an individual exchanger or it may be a part of a larger exchanger 600.

The processed refrigerant component 90 is directed to the regenerator 400. Pump 346 may be used to motivate the component 90 to the regenerator 400. As shown, the regenerator 400 is a still having a heater 420. The regenerator may be insulated via insulation 408 to aid in maintaining temperatures and efficiencies therein. The heater 420 heats the processed refrigerant component 90 to a boiling point where the water boils off thereby separating the water and the glycol. The water is directed along a condensation line 410 back to the evaporator entering as water 50H. The water may be motivated via pump 455. The glycol is directed along desiccant line 423 back to the separator 300. The regenerator includes a cross flow heat exchanger 720 that exchanges heat between the water condensate, the glycol, and the processed refrigerant component 90 biasing the three to a similar temperature. The efficiency of the chillers disclosed herein is related to the efficiency of the still non-recoverable chemical heat of mixing between the vapor and glycol, the pumping losses of water and gas, and the thermal insulation losses. Water requires 1000 BTU/LB to boil. A crossflow heat exchanger can recover most of this energy by using the outgoing heated flow. Such exchangers can separate the water from the liquid desiccant with a 10-20 F degree difference between incoming and exiting streams. At a specific heat of 1 BTU/LB-F, the separation cost only 10-20 BTU/LB. The chemical heat of mixing for most liquid desiccants is 50-100 BTU/LB and is not always recovered if other heat energy losses (pumping and insulation) are ignored. The desiccant can be separated for 60-120 BTU/LB.

After exiting the regenerator 400, the condensate line 410 may pass through an ambient air exchanger 600 lowering the condensate temperature. The condensate may be motivated via a still water pump 455 and directed to a second heat exchanger that biases the water temperature and the ladened air 60H temperature to be similar. The water is then directed back to the evaporator as water 50H and introduced into the first evaporator stack.

The glycol is directed from the still as a strong desiccant having been regenerated. The glycol may pass through the ambient heat exchanger 630 lowering the glycol temperature closer to ambient air temperature (not target air temperature) and returned to the separator 300 circuit.

The heat exchanger 630 may be isolated or may form a part of heat exchanger 600. The evaporator may direct chilled water 50C to a target environment 10 via heat exchanger 500. The chilled water 50C is the coldest water and may be directed via pump 270 to heat exchanger 500. The water from heat exchanger 500 is directed back to the evaporator 200 via conduit 517.

While FIG. 5 is described with regards to specific examples of components (e.g., water as refrigerant, air as evaporative fluid, stacked plates and evaporative mechanism, etc.), it should be appreciated that other embodiments or examples of the various components as described herein may be substituted herein without departing from the scope of this disclosure.

The chiller of FIG. 5 has the sealed liquid circuits contacting the refrigerant and the evaporative air via a bubble. Instrumentation of airflow temperatures and RH demonstrated that the water is cooled below the wet bulb. In one experiment with 0.3 L of liquid, the water was cooled 14 degrees F. while the desiccant gained 16 degrees F. The wet bulb had the vapor temperature down to a 10 degree F. depression demonstrating film cooling. The chiller system evaporates a refrigeration fluid with air in the staged bubble column that removes latent heat from the refrigerant fluid. Each stage accepts near wet bulb vapor from the cooler below and due to the higher temperature can continue absorbing water. The cycle allows a single dry air source to absorb water from the cold bottom pan to the top ambient temperature pan. The driest air enters the bottom pan where the coldest water collects. Heat is pulled from the water to support the evaporation such that the water approaches the dew point, which is colder than the wet bulb temperature of the damp rising air column. The chilled water is then delivered to a room radiator where it is used to provide cooling to the ambient air.

The wet bulb temperature vapor exits the top stage of the evaporator and is pumped to the liquid desiccant dryer. There it bubbles through staged liquid glycol that is purest at the top and diluted at the bottom. The diluted glycol exits the dryer, warmed by the latent heat of the absorbed vapor, and passes through a cross flow heat exchanger that raises the mixture to near boiling where an electric heater adds enough energy to boil the water. The vapor is condensed in the heat exchanger and returned to the evaporator after cooling in an ambient heat exchanger and another cross flow exchanger on the cooled damp air exit. The glycol return is then cooled by an ambient heat exchanger and returned at nearly full strength to the dryer.

In accordance with various embodiments, as illustrated in FIG. 6, a physiometric chart is provided providing expected information relative to the chiller system of FIG. 2. The physiometric chart illustrates how the cooling evaporation stages are linked. It shows that 10% RH air entering two baths can drop the air temperatures in the five stages. The illustrated chart includes large dots connected by a diagonal line (up and left) that represents cooling by evaporation. Each arrow that extends up and left shows that the drop in temperature is caused by evaporated water that raises the water content in the air from 20% to 80%. The 80% air leaving the colder stage has an amount of water in vapor form that can continue evaporation (and therefore is pulling heat from the water) in the warmer stage above. In this fashion, the evaporation of the water via the airflow can continue absorbing heat from the water as long as warmer trays are traversed in the multi-stage system. In the above example, the lowest web bulb temperature is 40 F and the starting temperature is over 120 F. Note that with adequate dry airflow at the bottom, 20% RH can achieve a dew point under 20 F.

In accordance with various embodiments, as illustrated in FIG. 7, a physiometric chart is provided providing expected information relative to the chiller system of FIG. 5.

The thermal cascade of baths provides continued evaporation despite the air's increasing water content. This single sequence of thermal baths keeps the air between 35-80% RH. Introducing two streams of dry air in separate evaporation tracks that skip the adjacent bath for the next warmer one can keep the air between 10-40% RH. This increase in vapor pressure greatly speeds the evaporation rate. (See FIG. 7.) The Dual Channel Evaporative Cascade (see FIG. 3) aspect of this chiller cycle has differences relative to a single channel (see FIG. 2). Note in the chart above that the alternating sets the diagonal lines (up and left) represents cooling by evaporation. Each arrow shows that temperature drop caused by evaporated water when the water content rises from 10% to 60% RH. Every other arrow up and left represents sequential baths along a single channel with the arrows between representing sequential baths along the other channel. The 60% air leaving the colder stages has an amount of water in vapor form that can continue evaporation if its temperature is raised enough. This chart shows that by skipping the adjacent water bath to the next one, that the RH is dropped to 10% RH. In this fashion, the rising air contacted with the water can continue absorbing heat from the water in baths that are drained into the next cooler bath. In other words, the vapor track skips a bath but the water path does not as shown in FIG. 3.

The overlapping portions of the adjacent arrows are there to absorb the increase in water that has to be removed. In the example illustrated in FIG. 7, the lowest web bulb temperature is 32 degrees F. while the starting temperature is 120 degrees F. The evaporation occurs much faster in the low RH areas, which is illustrates and unexpected benefit of the system of FIG. 3. Note that with adequate dry airflow at the bottom, 10% RH vapor has a dew point below freezing.

Efficiency is improved by passing the distilled water from the high side heat exchanger through a cross flow liquid/air exchanger using cooled saturated air leaving the evaporator. This lowers the temperature of the water returned to the evaporator to near wet bulb temperature, thereby reducing the required evaporative cooling load. The liquid desiccant works much better with lower temperatures so heat can be removed from the liquid desiccant with heat exchangers of the liquid between each bath.

As discussed above, the chiller system 100 operates at near ambient pressures. As a result, most of them can be made with flexible membranes that are thin which results in improved heat exchange. The pressure increases above ambient are the result of pressure differences created by blowers and liquid pumps. In some embodiments, these can be limited to less than ½ psig. This simplifies the design and cost for most parts of the system.

The chiller system 100 can also be incorporated in personal cooling devices.

For example, the chiller 100 can be constructed with most of the parts (e.g., except the pump and the still) being made from plastic channels heat welded into waterproof sheets. The radiator can be a sheet with heat welded cold water lines and then rolled loosely into a coil such that air can be blown through. Likewise, the dryer radiator. The two separator and evaporator can be made from flexible panels. In this way, the system could fit into a garment so as to provide a cold surface on the skin and a heat releasing outer surface. The glycol could be swapped and regenerated later or operated on battery, fuel, or fuel cell (that creates electric and heat).

The low/ambient pressure design allows the heat exchangers and much of the internal plumbing to be made from welded waterproof membranes. All the heal exchangers required by this design can be made by welding pathways and rolling the array into a loose roll that air can pass through. The crossflow heat exchanger for the still can be made the same way and tightly wound with insulation packed around the exterior. Urethane fabrics can accommodate boiling water temperatures and can even accommodate an electric heater element. Even the room exchanger can be made with membranes. Alternate designs could unfurl the device and hang it from the wall while avoiding a local fan. This design eliminates most of tubing and fittings required by conventional systems.

The chiller system 100 can also include a control system that provide for sensing and power distribution. The system can have digital and analog outputs and inputs and support a wide variety of motor and heater interfaces. A functional cabinet will house the chiller system, which will be connected to the room exchanger with a wire control harness and plastic tubing. The room cabinet will house the exchanger with a circulation fan, allowing it to become a functional AC unit.

It is appreciated that the refrigeration fluid, the evaporation fluid, and the separator component can include a broad range of substances as discussed above. While the specific characteristics of these substances are not necessarily disclosed herein, these characteristics would be known to a person of ordinary skill in the art in light of the aspects of the system disclosed herein. Therefore, these substances would be understood as being usable herewith. For example, the term "relative humidity" is used herein, which is commonly associated with water vapor. But, because other vapor substances are also contemplated (e.g., isopropyl alcohol because, as an example, it may similarly be utilized in the chiller system disclosed), it is appreciated that a person of ordinary skill in the art will understand the relative humidity analogies with these other vapors. For example, the percent relative humidity of these substances may be calculated by:

$$\frac{\text{vapor density}}{\text{saturation vapor density}} * 100$$

Thus, the characteristics of these other vapors can be understood in light of the disclosure herein. In another example, the refrigerant might be salt water, which has different freezing and boiling temperatures than distilled water. Nonetheless, a person of ordinary skill in the art will understand its applicability of such a substance (e.g., salt water) to the aspects of the disclosure provided herein based on its known characteristics. Thus, it is understood that the specific relationships and characteristics for water as a refrigerant in its liquid and gaseous states are described herein by way of example. Relationships for other substances are understood by persons of ordinary skill in the art and are not included herein for the clarity and conciseness of the disclosure.

In accordance with various embodiments, a personal cooling system is provided. In some examples, at least a portion of the personal cooling system can be positioned off the user. In other examples, the personal cooling system is fully supported by the user. In other examples, the personal cooling system is substantially enclosed within a usable wearable item (e.g. a partial protective covering, a coverall suit, or similar). In a preferred embodiment, the personal cooling system is suitably contained within a sealed or substantially sealed protective suit such as a sealed personal protective equipment (PPE) suit.

Figure 8B:
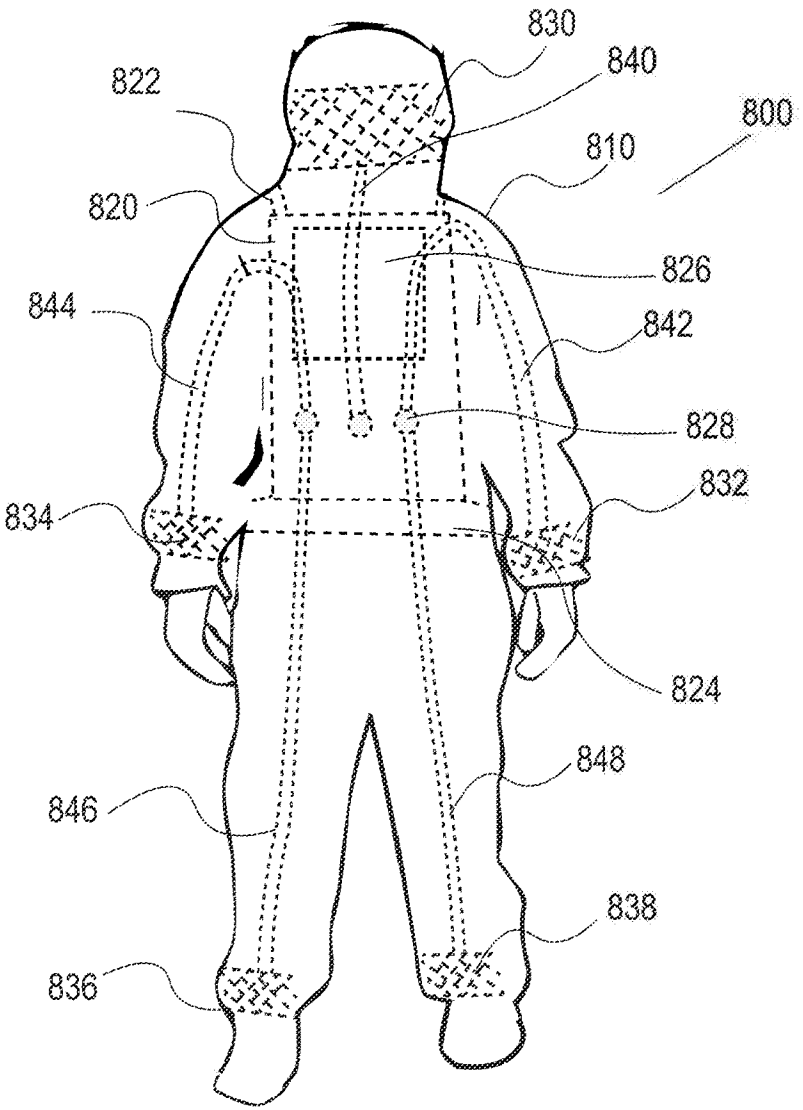
FIG. 8B illustrates the rear view of the example of an internal environmentally controlled personal protective system of FIG. 8A.
Figure 8A:
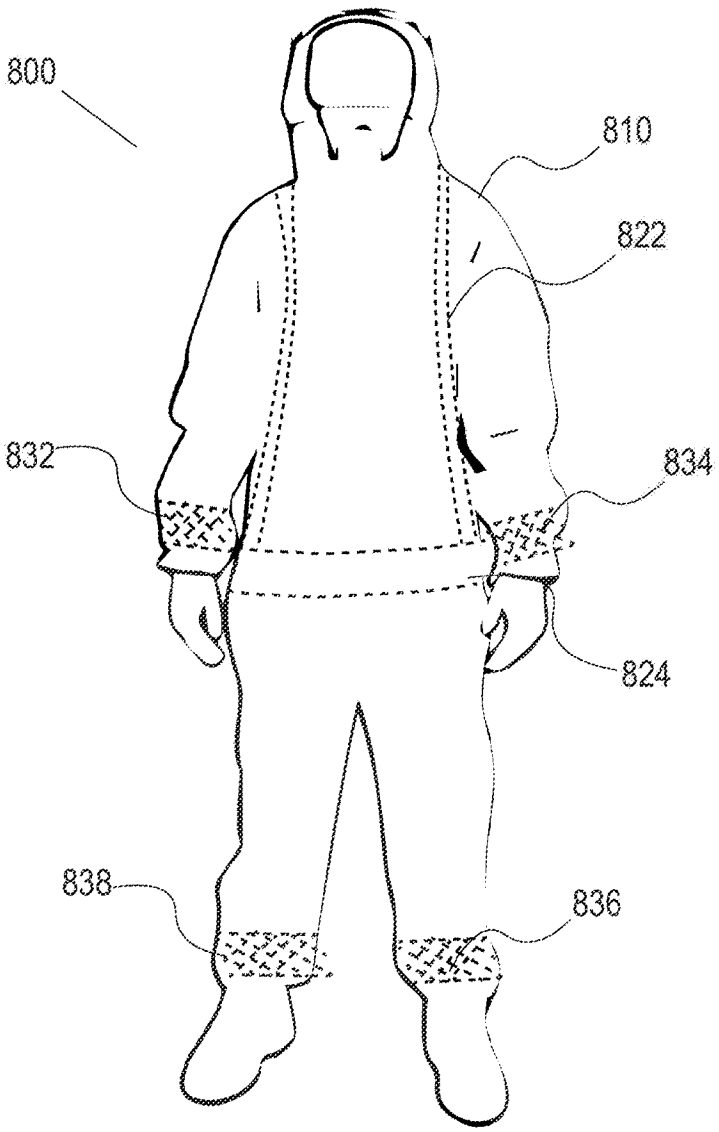
FIG. 8A illustrates a front view of an example of an internal environmentally controlled personal protective system.

Some of the basis and theory on which it is believed the system functions is included here for background understanding. However, the disclosure of the actual systems and processes disclosed herein should not be limited by any theory provided. It is believed that humans can generate approximately 150 watts of heat that can be removed in order to maintain normal temperature. Typically, sweating regulates this as long as the surrounding air is dry enough to absorb the vapor and circulate it away. The dry air evaporates the sweat, lowering the skin surface temperature in the process. In an enclosed suit, this evaporation process is disrupted. In accordance with various embodiments, as illustrated in FIGS. 8A and 8B, the internal environmentally controlled personal protective system 800 includes an internal cooling system 820 and a protective article 810. Traditional protective covering cooling designs use cold water (which requires 18.5× more mass) or ice (which requires 2.3× more mass) to accomplish the same cooling. In various embodiments as disclosed herein, the cooling system 820 weighs less than 3 lbs. (with desiccant e.g., glycol) and is donned under the protective covering and over clothing, providing for a more efficient lightweight system when compared to traditional solutions.

In various embodiments, the cooling system 820 is contained or substantially contained in the protective article 810. The protective article 810 can include different types of protective layers of material. The protective covering 810 can generally include any suitable PPE covering. For example, the protective covering 810 can be a fully sealed suit, (e.g., a hazardous material-type suit), a partially sealed suit, sub elements of a protective suit (e.g. hood, gloves, leggings, arm coverings, shoulder coverings, torso coverings, etc.) or similar protective coverings. In a preferred embodiment as shown in FIGS. 8A and 8B, the protective covering 810 is a substantially sealed suit suitable to protect against infectious diseases. In other embodiments, the protective covering can include coverings suitable to protection in other industries such as food production, manufacturing, construction, chemical handling, recreation (e.g., motorcycle suit or similar), or other industries that utilize protective coverings. With body coverings, in particular sealed coverings, air circulation is limited if not prohibited in and out of the covering, making it difficult to raise internal pressure of a cooling system without affecting the functionality of the body covering. The cooling system 820, in various embodiments, can be operated at low pressures within the substantially sealed suit. In preferred embodiments, the cooling system for protective suits is completely contained within the suit. In this way, the suit seals off outside gas, fluid, and particulates while sealing in the same. In the absence of internal cooling of such a suit, cooling by evaporating water from the user's skin fails and heat fatigue can set in quickly. With an internal cooling mechanism, the suit remains sealed so that limited or no contamination occurs while still allowing for internal cooling.

In accordance with various embodiments, the cooling system 820 includes an evaporator 830 and a separator 860. Generally, the evaporator and the separator can work on similar principles to those discussed above with regard to other embodiments of the chillers with the exception of being condensed to working with a protective covering 810. For example, one or both the evaporator 830 and separator 860 can be fully contained under the protective covering 810. The evaporator 830 brings the refrigeration fluid (e.g., sweat) and the evaporative fluid (e.g., relatively dry air) into contact with one another. This contact between the fluids allows a portion of the refrigeration fluid to evaporate and be transported with the evaporative fluid. This forms the ladened fluid that is transported to the separator 860. In some examples, the evaporative fluid is atmospheric air and the ladened fluid is evaporated sweat mixed with the atmospheric air. The separator then absorbs the refrigeration fluid (e.g. sweat) from the ladened fluid (e.g. ladened air), restoring it as an evaporative fluid (e.g., relatively dry air). Absorbing the refrigeration fluid also causes the separator to absorb energy being carried in the ladened fluid. In some examples, one or both of the refrigeration fluid (e.g. sweat) pulled from the evaporative fluid and/or the energy can then be stored in a reservoir during use of the protective covering. In some examples, the energy may be removed from the system via a heat exchanger 826.

In the example as shown, the evaporator 830 can be an evaporative interface that allows relatively dry air to contact a user's sweat, causing evaporative cooling at the skin proximal to the evaporator 830. As may be utilized in the cooling system 820, the dry air carries the vapor away, becoming a ladened fluid. This ladened fluid is then exposed to the separator 860, which separates the moisture out of the ladened fluid. In various examples, the evaporator may include an interface that circulates or otherwise contacts a user's skin with the evaporative fluid (e.g., dry air), causing evaporative cooling at the skin by evaporating the sweat off the skin. The evaporator can include a manifold for circulating the air proximal to the skin. The manifold can also include conduits or ducting for transporting evaporative fluid to the evaporator and transporting ladened air away from the evaporator. The cooling system 820 can include a single evaporator. Alternatively, the cooling system can include multiple evaporators at various appendages of the user. For example, as shown in FIGS. 8A and 8B, evaporators (e.g., 830, 832, 834, 836, and 838) can be located under the protective covering 810 at various locations around the user's body. For example, these locations can be at one or more of the user's wrists, ankles, head and/or other suitable cooling locations. Example aspects and elements of the cooling system 820 are shown in FIGS. 8A and 8B in broken line as being depicted under the protective suit.

In accordance with various embodiments, the separator 860 pulls the refrigerant fluid (e.g., sweat moisture) from the ladened fluid, restoring it as relatively dry air to be circulated back to the evaporator. In one example, the separator 860 is a liquid desiccator. In such an embodiment, the separation component is a liquid desiccant. In one example, the liquid desiccant includes glycol. In a particular example, the ladened fluid (e.g., air mixed with sweat moisture) is contacted with the liquid desiccant (e.g., glycol) to separate the evaporative fluid from the refrigerant fluid (e.g., sweat moisture). The evaporative fluid can then be returned to the evaporator 830 while the processed refrigerant component (e.g., the mixture of sweat moisture and glycol) is sent on for further processing by the system. In this process, the small amount of liquid desiccant (e.g., glycol) is heated by the body heat. As discussed below, systems can also be used to transfer this heat away. In some embodiments, the separator 860 could be similar to the separator 300 discussed above. As would be understood by persons of ordinary skill in the art, portions or all of the concepts of the separator 300 discussed above could be adapted to the cooling system 820 with adaptations for using under a protective covering 810. In accordance with various embodiments of the separator 860, a desiccant absorbs the water from the ladened fluid, forming a regenerated evaporative fluid. The evaporative fluid (e.g., relatively dry air) can then be used to evaporate more refrigerant fluid (e.g., sweat) and the desiccant can be further used to dry out the ladened fluid again. This process allows the body heat to be carried away by the ladened fluid and deposited into the desiccant. As discussed in more detail below, the contact between the ladened fluid and the desiccant can occur in different ways.

Again, returning to theory without limitation thereby, one half liter of water evaporated over 4 hours cools at about a 150 w rate and can be absorbed 1:1 in liquid glycol. This means Alternatively and/or additionally, Example 52 comprises the cooled protective covering system wearable by a user of Examples 31-51, that the system 800 can be used with ½ L glycol to end up with 1 L of mixed water (e.g., the moisture from the sweat) and glycol, where ½ L of water is removed from the user's body as sweat moisture. Merely exchanging the mixed solution of water and glycol for fresh glycol provides another 4 hours of cooling under these conditions.

In accordance with various embodiments, the cooling system 820 can also include a fluid distribution conduit. The ladened fluid and/or the evaporative fluid discussed above can be transferred or otherwise communicated between the separator and the evaporator via the fluid distribution conduit (see e.g., 840, 842, 844, 846, and/or 848 in FIGS. 8A and 8B). This dried air is then transported via flexible tubes to cooling target zones. As shown in this example, the cooling target zones can include ankles, wrists, head, neck, or other suitable user areas. This conduit can transport ladened fluid from the evaporators (e.g., 830, 832, 834, 838, and 836) and transport evaporative fluid to the evaporators (e.g., 830, 832, 834, 838, and 836), allowing the fluid circuit to bathe the user's body or target zones in the evaporative fluid (e.g., relatively dry air). In a preferred embodiment, the distribution conduit e.g., 840, 842, 844, 846, and/or 848 terminates at one end and is collected mid-trunk of the user, allowing the ladened fluid to be processed by the separator 860 at a common point. In other embodiments, this processing can be distributed as well (see e.g., FIGS. 11A and 11B).

Use of the evaporator 830 and the separator 860 under the protective covering 810 can result in a decrease in body surface temperature and an increase in desiccant temperature. In some embodiments, the stored heat energy in the desiccant can be exchanged to the air outside the suit via a heat exchanger 826. In other embodiments, a desiccant reservoir 850 can receive the desiccant and the heat abosorbed from the ladened fluid until thermal limits are reached.

In accordance with various embodiments, the cooling system 820 can also include a reservoir 850. For example, the reservoir can be used to contain the liquid desiccant (e.g., glycol). In proceeding with the evaporation and separation cycle as discussed above, the heat is collected and deposited, at least temporarily, into the desiccant (e.g., glycol) reservoir. This allows the reservoir temperature to climb to much higher temperatures while the user remains cooled. Similar to the non-user based embodiments discussed above, these embodiments operate at very low pressures (close to ambient) and as heat pumps, which dump the heat into a higher temperature reservoir. By operating the reservoir at hotter than the ambient temperatures, the heat from the reservoir can be dumped to the ambient environment via a heat exchanger 826, discussed below. In one example, the system 800 can be used with ½ L glycol stored in the reservoir 850 to end up with 1 L of mixed water and glycol, where ½ L of water is removed from the user's body as sweat moisture. The heat can be continuously stored in the reservoir until its thermal capacity is reached or, alternatively, some can be dumped to the environment via a heat exchanger. Merely exchanging the mixed solution of water and glycol for fresh glycol provides another 4 hours of cooling under these conditions. In embodiments in which the reservoir is used as a heat sink, the reservoir may be heavily insulated to separate the heat from the user. In other embodiments, the reservoir 850 may be plumbed with a heat exchanger to cycle the desiccant through the heat exchanger, removing heat therefrom. For example, without perforating the suit.

In accordance with various embodiments, the cooling system 820 can also include a heat exchanger 826. The heat exchanger 826 can be plumbed with the separator 860 and/or the reservoir 850 such that heat absorbed from the ladened fluid can be dumped out of the heat exchanger 826 to the environment. This allows the heat exchanger 826 to function as a convector/radiator. For example, in embodiments utilizing a liquid desiccant (e.g., glycol), the liquid desiccant can by fed (e.g., pumped or gravity fed) through the heat exchanger 826. In some embodiments, the liquid desiccant can be fed directly from the separator. In other embodiments, the liquid desiccant can be fed from the reservoir. In various embodiments, the heat exchanger 826 removes heat from the suit's interior by conduction through a panel temporarily bonded to the suit's membrane (preferably without perforating or otherwise puncturing it). In one example, the cooling system includes a vertical flat panel (see e.g. FIGS. 8B, 9, 10A and 10B) contacting the back of a suit material/membrane. In some examples, the panel may include a field of water paths (e.g., internal tubing) sufficiently dense so that liquid desiccant flowing through the paths passes heat from the desiccant to the tubing to the panel through the membrane and to the environment. In other embodiments, the panel may contain or otherwise contact, directly or indirectly, the reservoir such that heat from the reservoir passes through the panel through the suit material/membrane and to the environment. The panel contacting the suit material is of suitable size and shape to maximize heat transfer therethrough. For example, the panel may have a curve designed to increase the surface area thereof and stretch the suit material there against to maximize heat transfer. In one example, the back panel is sized such that it reaches a temperature 80° F. warmer than the ambient air, which theoretically will convectively transfer about 150 w.

Figure 9:
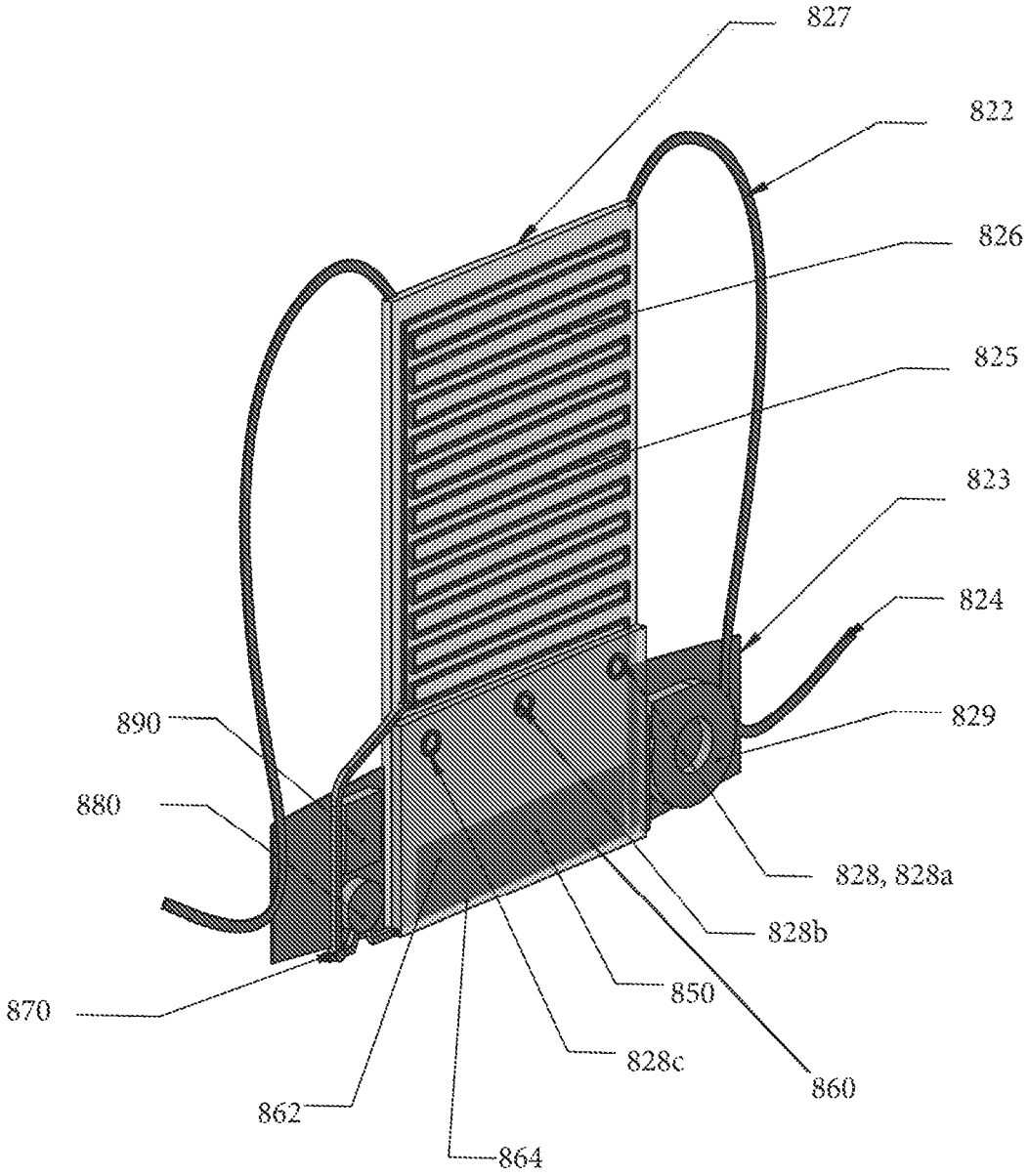
FIG. 9 illustrates an embodiment of an internal cooling system.

FIGS. 9-11B illustrate more specific embodiments of the above-discussed cooling system 820. In accordance with one embodiment, as illustrated in FIG. 9, the internal cooling system 820 may include a separator 860 configured as a bubbler. The separator 860 forms a part of the reservoir 850. Here a fluid pump 829 suitable to drive the ladened fluid is connected to the reservoir 850. The fluid pump 829 pushes the ladened fluid into the reservoir via an internal bubbler flap 862. The fluid pump 829 can be a blower fan suitable to push ladened fluid (e.g., sweat-moistened air) into the bubbler. The bubbler flap can have passages or alternating holes 864 on different sides of the flap suitable to allow ladened fluid into or through the reservoir. As the ladened fluid bubbles through the reservoir, the moisture is stripped from the fluid, drying it out and regenerating the evaporative fluid. A distribution manifold can be positioned in the reservoir to catch and distribute the evaporative fluid out via ports 828. Separate ports can go to separate target zones. For example, port 828*a* can go to right side of the user (e.g. right wrist and/or ankle); port 828*b* can go to the head/neck target zone; and/or port 828*c* can go to the left side of the user (e.g., left wrist and/or ankle).

The separator 860 can include a pump 880 operable to circulate desiccant through the heat exchanger 826. More specifically, the desiccant can be circulated through the path (e.g., tubing shown) 825 forming a part of the panel. This panel heat exchanger 826 can contact the interior back of the protective covering (e.g., hazmat suit) and allow the desiccant to dump its heat there through. The user can be separated from this heat exchanger via an insulated pad 827.

The cooling system 820 can also include a waist pack suitable to support one or more of a power unit 890 (e.g., batter and/or controller), a valve 870, the pump 880, the blower 829, waist straps 824, and/or shoulder straps 822. The power unit 890 can control and power the pumps and fans. The valve 870 can allow for changing or cycling the desiccant. The waist straps 824 and shoulder straps 822 can support the unit on the user.

Figure 10A:
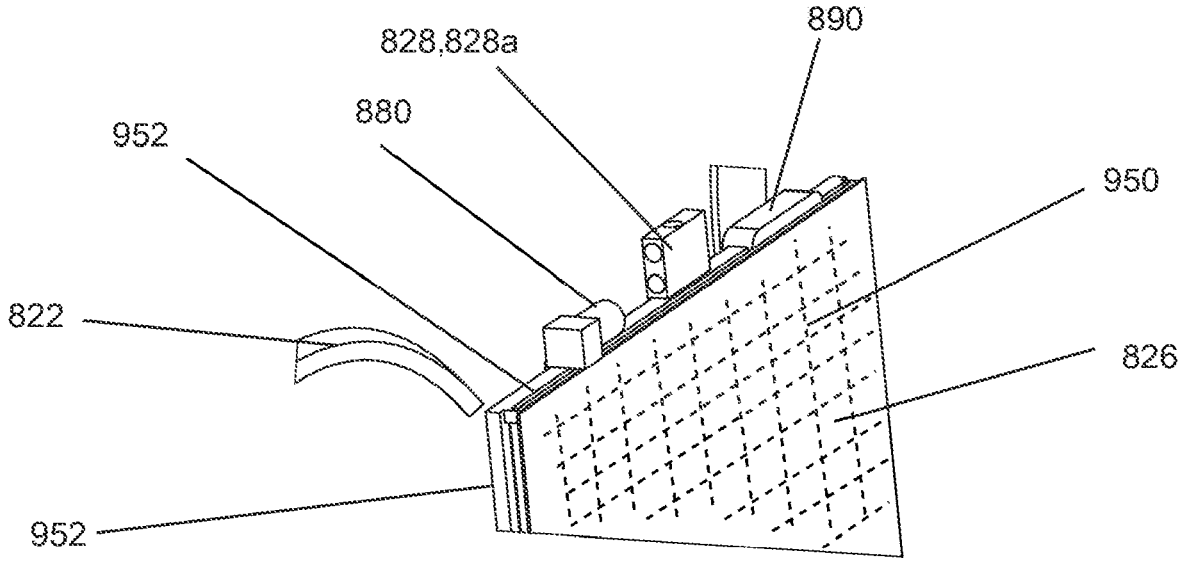
FIG. 10A illustrates the top portion of a rear perspective view of another embodiment of an internal cooling system.
Figure 10B:
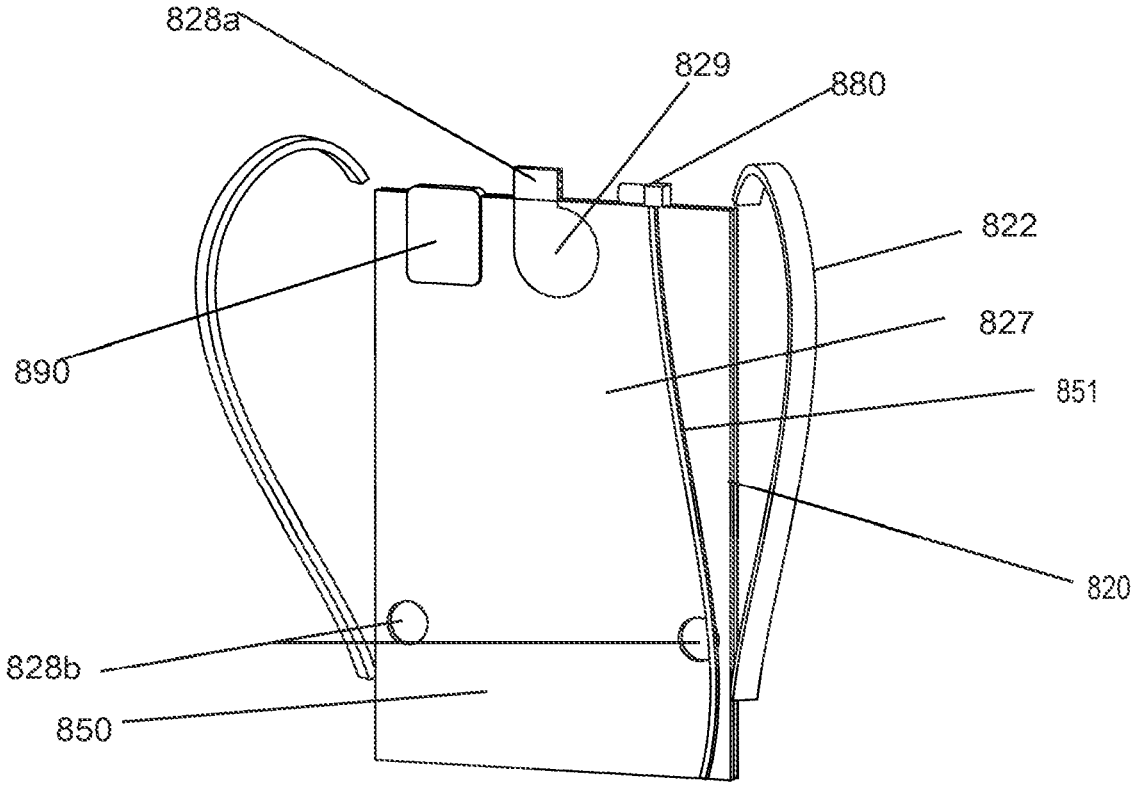
FIG. 10B illustrates the front perspective view of the embodiment of an internal cooling system of FIG. 10A.

In accordance with another embodiment, as illustrated in FIGS. 10A and 10B, the internal cooling system 820 may include a separator 860 configured as a film separator. In one embodiment, the film separator can include internal wicks 950. The wicks 950 are shown in FIG. 10A in dashed lines illustrating that they are interior to the rear panel 826. In such an embodiment, the cooling system 820 continuously circulates evaporative fluid (e.g., dried air) from liquid wetted wicks 950 to target zones having evaporators. The evaporators (e.g. 830 discussed above) laden the evaporative fluid (e.g., dried air) with moisture from the user's sweat. The ladened air is carried back to the separator 860 that includes internal wicks 950 coated with desiccant (e.g., glycol). The ladened air is pushed through the internal wicks 950, contacting the ladened air and the desiccant on the wicks. Heat and moisture removed from the body through evaporation is deposited into the liquid desiccant on the vertical wicks. The desiccant can be continuously cycled to the top of the wicks, allowing it to drain down them. In various embodiments, one or more of the wicks are bonded to a flat plate heat exchanger 826 on the back panel. Heat is conducted through the PPE back membrane layer where it is dispersed to the exterior.

In this embodiment, a controller 890 can operate one or more of the desiccant pump 880 and/or the blower 829. The desiccant pump can pull the desiccant from the desiccant reservoir 850 along the desiccant suction line 851. The desiccant is then distributed to the wicks via the desiccant wick supply path 952. The blower 829 can move the evaporative fluid and the ladened fluid via the conduits discussed above from the ports 828 (e.g., evaporative fluid port 828*a*, ladened fluid 828*b*). The insulated pad 827 can be used to separate the heat in the heat exchanger 826 and the user. The strap 822 can be used to support the cooling unit 820 on the user.

Not to be limited by the theory, it is supposed that removing 120 w of heat from a user with an evaporative fluid (e.g. dry air at 10% relative humidity) by absorbing sweat moisture resulting in a ladened fluid (e.g. moistened air at 80% relative humidity) uses about 15 cubic feet per minute of air movement under standard conditions. This amount of flow may be difficult to achieve. As such, flowing vertical films of desiccant (like the current HVAC cooler design e.g., swamp coolers) down through wick material on both sides of a stream of air can lower the blower demands. The cross flow arrangement allows the desiccant to puddle in the bottom where it is pulled by a liquid pump for continuous cycling. The outside wick can be bonded to a metal panel that conducts the heat to the PPE back panel for exterior heat exchange.

In accordance with various embodiments, a tube can be passed out of the suit for glycol exchange. For example, a small rechargeable battery of 1000 mwh operates the fan and pump for over 8 hours. Once ½ L of water has been absorbed, the mixture is pumped out and fresh glycol is pumped back in through a single ¼" tube that is passed out of the suit (this length can be cleaned or disposed of as needed). However, the preferred embodiment is to have the glycol fully stored within the suit, keeping the suit fully sealed. In some embodiments, starting with 1 L of glycol, a full 8 hours of cooling can be achieved.

In other embodiments, the cooling system can include a version that does not cycle the air volume between desiccant and evaporator. It instead arranges cascading surfaces of both desiccant and water close together (<0.1"). The moving films and close proximity provide good vapor transfer. In such an embodiment, the wicks above can be replaced by moving films of the desiccant fluid and the ladened fluid. Alternatively and/or additionally, the wicks can be made of metal wool which provides for low resistance flow of both vapor and liquid. One example is below. This example is provided as a localized cooler, but could be incorporated in similar designs to those above.

Figure 11A:
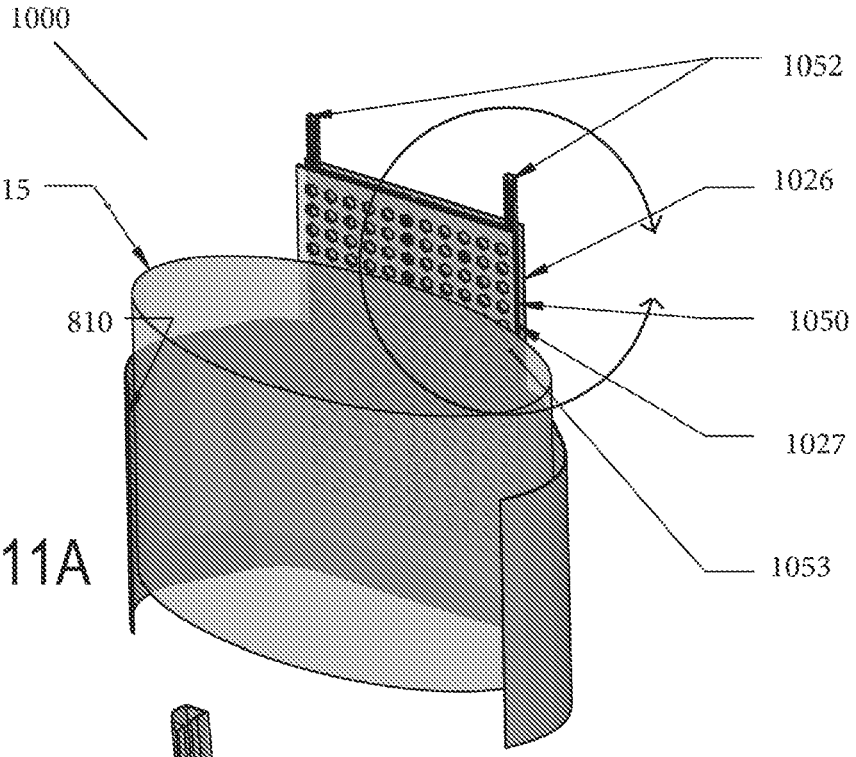
FIG. 11A illustrates a perspective view of an embodiment of a localized internal cooling system.
Figure 11B:
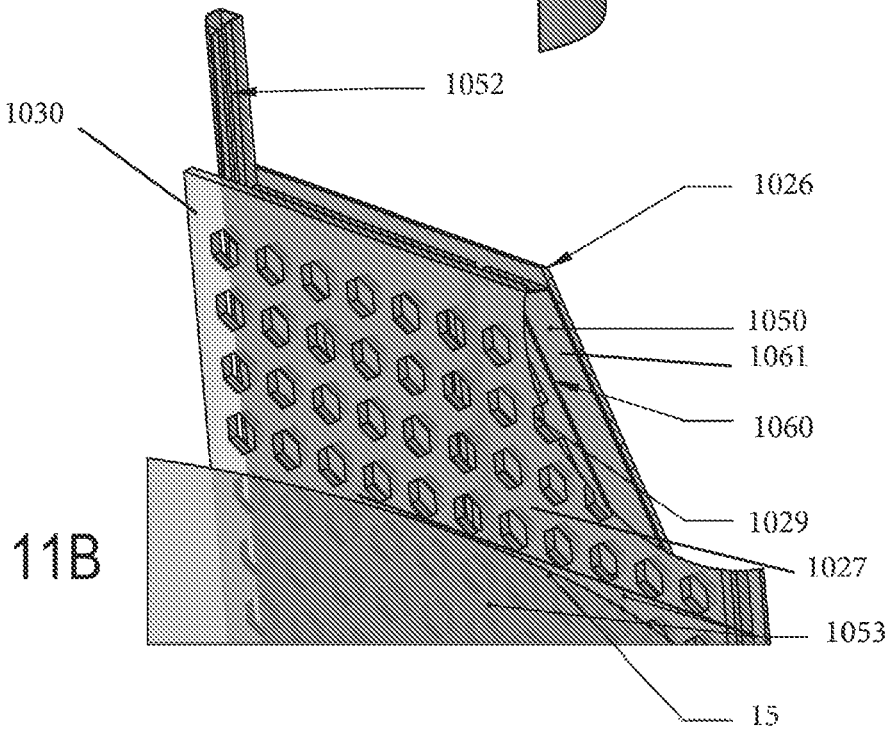
FIG. 11B illustrates a detailed perspective view of the embodiment of a localized internal cooling system of FIG. 11A.

In accordance with another embodiment, as illustrated in FIGS. 11A and 11B, the internal cooling system 820 may be configured as one or more localized cooling devices 1000 that serve individual target zones. Similar to the above system, the localized cooler system 1000 can be used with a protective suit. The localized cooler system 1000 includes a separator 1060 in close proximity to the evaporator 1030. Here the evaporator 1030 can include an insulating layer 1027 that separates the user body 15 from the separator 1060. The insulating layer 1027 includes perforations 1029 that allow for vapor diffusion across the insulating layer, forming a vapor diffusion region. The separator 1060 includes a breathable vapor membrane 1061. The vapor membrane can be hydrophobic and/or desiccant-phobic (e.g., glycol phonic). The vapor membrane can separate the vapor diffusion region from a desiccant reservoir. The desiccant reservoir 1050 can include desiccant exchange ports 1052 for changing out desiccant once used. A heat exchange panel 1026 can be in direct or indirect contact with or form one side of the reservoir allowing for heat exchange out of the reservoir. The panel 1026 can be in direct or indirect contact with the protective covering 810 such that heat exchange can occur across the covering. In this way, heat contained in the desiccant can be dumped external to the covering.

In this embodiment, the cooling system 1000 continuously dries air near proximity with the breathable membrane 1061. The moisture is carried in the vapor across the membrane and deposited in the desiccant. The evaporative fluid (e.g., air) can cross the barrier but the desiccant (e.g., glycol) is limited. This allows heat to be removed from the body through normal evaporation and deposited into the liquid desiccant across the porous insulator 1027. As the desiccant absorbs moisture, its volume expands. This expansion of desiccant can allow the desiccant to fill the reservoir 1050, or allow the desiccant to be moved out of the device via ports 1052 to other reservoirs or pads. The ports 1052 can also direct heat-ladened desiccant to other heat exchangers.

In accordance with embodiments related to the cooling units 820 discussed above, the desiccant can be added to the cooling system and the covering 810 before use. The user then can use the cooling properties of the system 820 until the desiccant is no longer functional, having fully absorbed the moisture it can hold. The covering 810 can then be removed and the desiccant can then be removed from the covering 810 and system 820. The desiccant can then be regenerated by boiling off the moisture as discussed in the other embodiments provided herein. This process allows the covering 810 to remain sealed. The system 820 does not have to be decontaminated and its liquid desiccant can be recycled by simply boiling off the water after removal from the covering 810. This cooling device increases compliance with safety recommendations for infectious diseases and hazardous materials. Using this device, health care providers may choose to stay in the cool suit longer or during breaks because of increased comfort, thereby increasing safety by reducing suit changes. This can also reduce costs because many PPE suits are one-time use and are discarded after overheating in less than an hour.

In some embodiments, the system can function as a heater as opposed to a cooler. For example, a portable heater can utilize the heat generated in the liquid desiccant when it absorbs the vapor. An example application of such a system could include a motorcycle-heated suit. Traditional motorcycle suits max out at about 80 w. Similar systems, e.g., portable battery socks/vests and gloves, max out at 15 w. Utilizing the disclosure provided herein, a system absorbing water vapor generates continuous heat. It is believed that a system absorbing 0.66 L of water vapor over 4 hours can generate 100 w of continuous heat. This is an alternative way to apply the cooling cycle worked on before.

Example 1 may include a chiller system that includes a refrigeration fluid, an evaporative fluid, and an evaporator that contacts the refrigeration fluid and the evaporative fluid to cause a portion of the refrigeration fluid to evaporate; further including an output heat exchanger that receives at least a portion of an adjacent refrigeration fluid and increases the temperature thereof by transferring the heat of an outside environment of the heat exchanger to the adjacent refrigeration fluid, wherein the heat exchanger directs the portion of the adjacent refrigeration fluid back to the evaporator; further including a separator that receives the evaporative fluid and the evaporated refrigeration fluid and separates the two by contacting them with a separator component, resulting in a separated evaporative fluid and a processed refrigeration component allowing the separated evaporative fluid to return to the evaporator; and further including a regenerator that receives the processed refrigeration component and isolates the refrigeration fluid therein for return to the evaporator, wherein the sealed fluid chiller system may operate the refrigeration fluid and the evaporative fluid at a pressure less than 2 bar over atmospheric pressure.

Alternatively and/or additionally, Example 2 comprises Example 1, wherein the refrigeration fluid comprises water.

Alternatively and/or additionally, Example 3 comprises one or more of Example 1-2, wherein the evaporator is configured to receive the evaporative fluid after it has been separated from the refrigeration fluid in the separator.

Alternatively and/or additionally, Example 4 comprises one or more of Example 1-3, wherein the evaporator includes cascading evaporator stages such that the evaporative fluid contacts the refrigeration fluid in multiple different stages at multiple different temperatures.

Alternatively and/or additionally, Example 5 comprises one or more of Example 1-4, wherein the separator includes a liquid desiccator.

Alternatively and/or additionally, Example 6 comprises one or more of Example 1-5, wherein the liquid desiccator includes a cascading liquid desiccator having a plurality of cascading drying stages in which the evaporative fluid contacts a liquid desiccant in multiple different stages at multiple different temperatures to sequentially dry the evaporative fluid.

Alternatively and/or additionally, Example 7 comprises one or more of Example 1-6, wherein the liquid desiccant is glycol.

Alternatively and/or additionally, Example 8 comprises one or more of Example 1-7, wherein the regenerator includes a still configured to separate the refrigeration fluid and the desiccant.

Alternatively and/or additionally, Example 9 comprises one or more of Example 1-8, wherein the separated refrigeration fluid is directed back to the evaporator and the separated desiccant is directed back to the separator.

Alternatively and/or additionally, Example 10 comprises one or more of Example 1-9, further comprising an ambient heat exchanger that receives the refrigeration fluid from the regenerator and directs the refrigeration fluid to the evaporator.

Alternatively and/or additionally, Example 11 comprises one or more of Example 1-10, further comprising an ambient heat exchanger that receives the desiccant from the regenerator and directs the desiccant to the separator.

Alternatively and/or additionally, Example 12 comprises one or more of Example 1-11, further comprising a system heat exchanger.

Alternatively and/or additionally, Example 13 comprises one or more of Example 1-12, wherein, the system heat exchanger exchanges the heat between at least a portion of the refrigerant fluid entering at an evaporator refrigerant fluid inlet and at least a portion of evaporative fluid exiting at an evaporative fluid outlet on the evaporator.

Alternatively and/or additionally, Example 14 comprises one or more of Example 1-13, wherein the evaporative fluid is air.

Alternatively and/or additionally, Example 15 comprises one or more of Example 1-14, wherein the evaporative fluid operates within the system between 1/10 bar over atmospheric pressure and 1 bar over atmospheric pressure.

Alternatively and/or additionally, Example 16 comprises one or more of Example 1-15, wherein the evaporator is a stacked plate evaporator.

Alternatively and/or additionally, Example 17 comprises one or more of Example 1-6, wherein the separator is a stacked plate separator.

Example 18 may include a cascading evaporator comprising an evaporative fluid inlet, a refrigerant fluid reservoir, and a first evaporator stage that is configured to receive an evaporative fluid and contact the evaporative fluid with a refrigerant fluid at a first temperature such that a portion of the refrigerant fluid is evaporated and transported with the evaporative fluid as a ladened fluid; and further comprising a second evaporator stage configured to receive the ladened fluid and further configured to contact the ladened fluid with the refrigerant fluid at a second temperature such that a portion of the refrigerant fluid is evaporated and transported with the ladened fluid forming a second ladened fluid.

Alternatively and/or additionally, Example 19 comprises Example 18, wherein the cascading evaporator is operable to increase the evaporative fluid temperature by 30-50 degrees in the cascading evaporator.

Alternatively and/or additionally, Example 20 comprises one or more of Examples 18-19, further comprising a refrigerant fluid outlet.

Alternatively and/or additionally, Example 21 comprises one or more of Examples 18-20, wherein the refrigerant fluid outlet is connected with a heat exchanger.

Alternatively and/or additionally, Example 22 comprises one or more of Examples 18-21, further comprising an evaporative fluid outlet configured to direct a moisture-ladened evaporative fluid away from the cascading evaporator.

Alternatively and/or additionally, Example 23 comprises one or more of Examples 18-22, further comprising a refrigerant inlet.

Alternatively and/or additionally, Example 24 comprises one or more of Examples 18-23, wherein the refrigerant inlet is on the same side of the first and second evaporator stages as the evaporative fluid outlet.

Alternatively and/or additionally, Example 25 comprises one or more of Examples 18-24, further comprising a heat exchanger that exchanges heat between at least a portion of the refrigerant fluid entering at the refrigerant inlet with at least a portion of evaporative fluid exiting at the evaporative fluid outlet.

Alternatively and/or additionally, Example 26 comprises one or more of Examples 18-25, wherein the evaporative fluid includes an evaporative fluid pressure that is between 1/10 of bar over atmospheric pressure and 1 bar over atmospheric pressure.

Alternatively and/or additionally, Example 27 comprises one or more of Examples 18-26, wherein the evaporator is a stacked plate evaporator.

Alternatively and/or additionally, Example 28 comprises one or more of Examples 18-27, wherein the separator is a stacked plate separator.

Alternatively and/or additionally, Example 29 comprises a fluid chiller system that comprises the cascading evaporator of one or more of Examples 18-28, the fluid chiller system further comprising a liquid desiccator, a regenerator, and a plurality of heat exchanges.

Alternatively and/or additionally, Example 30 comprises one or more of Examples 18-29, wherein the system is fit into a wearable garment with an external heat exchanger that exchanges heat collected between the refrigerant fluid and a user's skin to the outside of the suit.

Example 31 may include a cooled protective covering system wearable by a user comprising: a protective covering; and an internal cooling system. The internal cooling system having an evaporator contained within the protective covering and positioned to be placed in close proximity the user's skin when the protective covering is worn, such that air directed through the evaporator is able to evaporate moisture from the skin to form a ladened air and a separator contained within the protective covering and in fluid communication with the evaporator such that ladened air from the evaporator is directed to the separator allowing the separator to absorb moisture from the ladened air.

Alternatively and/or additionally, Example 32 comprises the cooled protective covering system wearable by a user of Example 31, wherein the fluid communication between the evaporator and the separator is accomplished via a ladened air conduit that connects the evaporator and the separator.

Alternatively and/or additionally, Example 33 comprises the cooled protective covering system wearable by a user of Examples 31-32, wherein the separator includes a liquid desiccant suitable to absorb moisture.

Alternatively and/or additionally, Example 34 comprises the cooled protective covering system wearable by a user of Examples 31-33, wherein the desiccant is glycol.

Alternatively and/or additionally, Example 35 comprises the cooled protective covering system wearable by a user of Examples 31-34, wherein the separator contacts the ladened air with a desiccant, drying the ladened air forming dried air for return to the evaporator.

Alternatively and/or additionally, Example 36 comprises the cooled protective covering system wearable by a user of Examples 31-35, further comprising a fluid conduit from the separator to the evaporator configured to return air dried by the desiccant to the evaporator.

Alternatively and/or additionally, Example 37 comprises the cooled protective covering system wearable by a user of Examples 31-36, wherein the protective covering is a sealed coverall suit suitable for protection of the user in dealing with infectious diseases.

Alternatively and/or additionally, Example 38 comprises the cooled protective covering system wearable by a user of Examples 31-37, wherein the separator is a bubbler configured to bubble the ladened air through the desiccant.

Alternatively and/or additionally, Example 39 comprises the cooled protective covering system wearable by a user of Example 31-38, further comprising a reservoir suitable to hold a liquid desiccant and the ladened air is directed to bubble through the desiccant in the reservoir.

Alternatively and/or additionally, Example 40 comprises the cooled protective covering system wearable by a user of Examples 31-37, wherein the separator includes a breathable membrane.

Alternatively and/or additionally, Example 41 comprises the cooled protective covering system wearable by a user of Examples 31-37 and 40, wherein breathable membrane is separated from the user's skin by a perforated insulator.

Alternatively and/or additionally, Example 42 comprises the cooled protective covering system wearable by a user of Examples 31-37, wherein the separator includes a wicking layer.

Alternatively and/or additionally, Example 43 comprises the cooled protective covering system wearable by a user of Examples 31-37 and 42, wherein the desiccant drains through the wicking layer forming a desiccant coated wicking layer and the ladened air passes through the desiccant coated wicking layer.

Alternatively and/or additionally, Example 44 comprises the cooled protective covering system wearable by a user of Examples 31-43, wherein further comprising a desiccant reservoir configured to store the liquid desiccant under the protective covering.

Alternatively and/or additionally, Example 45 comprises the cooled protective covering system wearable by a user of Examples 31-44, wherein the desiccant reservoir is sufficiently large to absorb moisture from the user for at least 4 hours.

Alternatively and/or additionally, Example 46 comprises the cooled protective covering system wearable by a user of Examples 31-45, wherein further comprising a heat exchanger configured to release heat energy built up in the desiccant.

Alternatively and/or additionally, Example 47 comprises the cooled protective covering system wearable by a user of Examples 31-46, wherein the heat exchanger is a panel positioned to contact and exchange heat energy though a back panel of the protective covering.

Alternatively and/or additionally, Example 48 comprises the cooled protective covering system wearable by a user of Examples 31-47, wherein desiccant is directed from the reservoir through a heat exchange path proximal to the panel.

Alternatively and/or additionally, Example 49 comprises the cooled protective covering system wearable by a user of Examples 31-48, wherein the reservoir is proximal to the panel allowing heat to exchange from the reservoir through the panel to the protective covering.

Alternatively and/or additionally, Example 50 comprises the cooled protective covering system wearable by a user of Examples 31-49, wherein the internal cooling system is as a back mounted unit wearable by the user on the user's back under the protective covering.

Alternatively and/or additionally, Example 51 comprises the cooled protective covering system wearable by a user of Examples 31-50, wherein the back mounted unit includes should straps for support on the user's back.

Alternatively and/or additionally, Example 52 comprises the cooled protective covering system wearable by a user of Examples 31-51, wherein the internal cooling system is a localized unit with the evaporator and the desiccant interface positioned together and supportable on a user's appendage.

Alternatively and/or additionally, Example 53 comprises the cooled protective covering system wearable by a user of Examples 31-52, further comprising a plurality of internal cooling systems with each of the plurality of internal cooling systems being located on a separate user appendage.

Of course, it is to be appreciated that any one of the examples, embodiments, or processes described herein may be combined with one or more other examples, embodiments, and/or processes or be separated and/or performed amongst separate devices or device portions in accordance with the present apparatuses, devices, and methods.

Having described several embodiments herein, it will be recognized by those skilled in the art that various modifications, alternative constructions, and equivalents may be used. The various examples and embodiments may be employed separately or they may be mixed and matched in combination to form any iteration of the alternatives. Additionally, a number of well-known processes and elements have not been described in order to avoid unnecessarily obscuring the focus of the present disclosure. Accordingly, the above description should not be taken as limiting the scope of the invention. Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A sealed fluid chiller system comprising:

a refrigeration fluid;

an evaporative fluid;

an evaporator that contacts the refrigeration fluid and the evaporative fluid to cause a portion of the refrigeration fluid to evaporate;

an output heat exchanger configured to receive at least a portion of an adjacent refrigeration fluid and increase the temperature thereof by transferring the heat of an outside environment of the output heat exchanger to the adjacent refrigeration fluid, wherein the output heat exchanger directs the portion of the adjacent refrigeration fluid back to the evaporator;

a separator that receives the evaporative fluid and the evaporated refrigeration fluid and separates the two by contacting them with a separator component resulting in a separated evaporative fluid and a processed refrigeration component allowing the separated evaporative fluid to return to the evaporator; and a regenerator that receives the processed refrigeration component and isolates the refrigeration fluid therein for return to the evaporator, wherein the evaporator, the output heat exchanger, the separator, and the regenerator maintain the refrigeration fluid, the evaporative fluid, and the separator component in a sealed system, wherein the sealed fluid chiller system operates the refrigeration fluid and the evaporative fluid at a pressure less than 2 bar over atmospheric pressure.

2. The sealed fluid chiller system of claim 1, wherein the refrigeration fluid comprises water.

3. The sealed fluid chiller system of claim 1, wherein the evaporator is configured to receive the evaporative fluid after it has been separated from the refrigeration fluid in the separator.

4. The sealed fluid chiller system of claim 1, wherein the evaporator includes cascading evaporator stages such that the evaporative fluid contacts the refrigeration fluid in multiple different stages at multiple different temperatures.

5. The sealed fluid chiller system of claim 1, wherein the separator includes a liquid desiccator.

6. The sealed fluid chiller system of claim 5, wherein the liquid desiccator includes a cascading liquid desiccator having a plurality of cascading drying stages in which the evaporative fluid contacts a liquid desiccant in multiple different stages at multiple different temperatures to sequentially dry the evaporative fluid.

7. The sealed fluid chiller system of claim 6, wherein the liquid desiccant is glycol.

8. The sealed fluid chiller system of claim 7, wherein the regenerator includes a still configured to separate the refrigeration fluid and the desiccant.

9. The sealed fluid chiller system of claim 7, wherein the separated refrigeration fluid is directed back to the evaporator and the separated desiccant is directed back to the separator.

10. The sealed fluid chiller system of claim 7, further comprising an ambient heat exchanger that receives the refrigeration fluid from the regenerator and directs the refrigeration fluid to the evaporator.

11. The sealed fluid chiller system of claim 7, further comprising an ambient heat exchanger that receives the desiccant from the regenerator and directs the desiccant to the separator.

12. The sealed fluid chiller system of claim 1, further comprising a first heat exchanger and a second heat exchanger.

13. The sealed fluid chiller system of claim 12, wherein, the first heat exchanger exchanges the heat between at least a portion of the refrigerant fluid entering at an evaporator refrigerant fluid inlet and the second heat exchanger exchanges the heat between at least a portion of evaporative fluid exiting at an evaporative fluid outlet on the evaporator.

14. The sealed fluid chiller system of claim 1, wherein the evaporative fluid is air.

15. The sealed fluid chiller system of claim 1, wherein the evaporative fluid operates within the system between 1/10 bar over atmospheric pressure and 1 bar over atmospheric pressure.

* * * * *